US011124983B2

(12) United States Patent
Sebor et al.

(10) Patent No.: US 11,124,983 B2
(45) Date of Patent: Sep. 21, 2021

(54) AUTOMATIC POOL CLEANER

(71) Applicants: Pavel Sebor, Heathrow, FL (US); Robert Sebor, Lake Mary, FL (US)

(72) Inventors: Pavel Sebor, Heathrow, FL (US); Robert Sebor, Lake Mary, FL (US)

( * ) Notice: Subject to any disclaimer, the term of this patent is extended or adjusted under 35 U.S.C. 154(b) by 0 days.

(21) Appl. No.: 17/176,292

(22) Filed: Feb. 16, 2021

(65) Prior Publication Data

US 2021/0254359 A1 Aug. 19, 2021

Related U.S. Application Data

(60) Provisional application No. 62/978,529, filed on Feb. 19, 2020.

(51) Int. Cl.
*E04H 4/16* (2006.01)

(52) U.S. Cl.
CPC ..... *E04H 4/1672* (2013.01); *E04H 4/16* (2013.01); *E04H 4/1636* (2013.01); *E04H 4/1654* (2013.01)

(58) Field of Classification Search
CPC ..... E04H 4/16; E04H 4/1654; E04H 4/1636
See application file for complete search history.

(56) References Cited

U.S. PATENT DOCUMENTS

| | | | |
|---|---|---|---|
| 747,574 | A | 12/1903 | Bacharach |
| 2,556,022 | A | 6/1951 | Atiyeh |
| 2,605,902 | A | 8/1952 | Russell |
| 2,641,015 | A | 6/1953 | Lovick |
| 2,846,711 | A | 8/1958 | Brace |
| 3,011,643 | A | 12/1961 | Mccoy |
| 3,019,462 | A | 2/1962 | Jacuzzi et al. |
| 3,074,087 | A | 1/1963 | Drennan |
| 3,178,024 | A | 4/1965 | Candido |
| 3,252,575 | A | 5/1966 | Jacuzzi |
| 3,640,390 | A | 2/1972 | Goy et al. |
| 3,795,027 | A | 3/1974 | Lindberg |
| 3,950,809 | A | 4/1976 | Schatzmann |
| 3,959,838 | A | 6/1976 | Hannah |
| 3,960,809 | A | 6/1976 | Ramey et al. |
| 4,254,525 | A | 3/1981 | Combest |

(Continued)

FOREIGN PATENT DOCUMENTS

| | | | |
|---|---|---|---|
| CN | 202289676 | U | 7/2012 |
| CN | 202315518 | U | 7/2012 |

(Continued)

OTHER PUBLICATIONS

Hayward EC65A D.E. Complete Pool Filter; http://www.amazon.com/Hayward-EC65A-Complete-Pool-Filter/dp/B000FNAN7M.

(Continued)

*Primary Examiner* — Michael D Jennings
(74) *Attorney, Agent, or Firm* — Christopher M. Ramsey; GrayRobinson, P.A.

(57) ABSTRACT

A pool cleaner includes a vent mechanism and a water port in fluid communication with the vent mechanism. When a forward end of the pool cleaner extends above a waterline of the pool, water flows through the vent mechanism and the water port over a plenum and prevents loss of suction at the cleaner's inlet port. A protruding member of the pool cleaner contacts submerged obstacle and tilts the pool cleaner to prevent the pool cleaner from becoming stuck on the submerged obstacle.

20 Claims, 14 Drawing Sheets

(56) References Cited

U.S. PATENT DOCUMENTS 4,304,022 A 12/1981 Sommer
4,498,206 A 2/1985 Braukmann
4,536,908 A 8/1985 Raubenheimer
4,558,479 A 12/1985 Greskovics et al.
4,589,986 A 5/1986 Greskovics et al.
4,656,683 A 4/1987 Raubenheimer
4,683,599 A 8/1987 Rief
4,722,110 A 2/1988 Chandler
4,817,991 A 4/1989 Frentzel et al.
D304,505 S 11/1989 Maier et al.
4,920,599 A 5/1990 Rief
5,001,800 A 3/1991 Parenti et al.
5,033,149 A 7/1991 Russo
5,097,559 A 3/1992 Brunt et al.
5,099,535 A 3/1992 Chayvuer et al.
5,172,445 A 12/1992 Chandler
5,197,158 A 3/1993 Moini
5,269,913 A 12/1993 Atkins
5,293,659 A 3/1994 Rief et al.
5,337,434 A 8/1994 Erlich
5,338,446 A 8/1994 Schuman et al.
5,351,355 A 10/1994 Chiniara
5,363,877 A 11/1994 Frentzel et al.
5,379,473 A 1/1995 Rief et al.
5,428,854 A 7/1995 Rief et al.
5,454,129 A 10/1995 Kell
5,469,596 A 11/1995 Rief et al.
5,507,058 A 4/1996 Minami et al.
5,554,277 A 9/1996 Rief et al.
5,557,822 A 9/1996 Yagi et al.
D376,450 S 12/1996 Campbell et al.
5,604,950 A 2/1997 Stern
5,617,600 A 4/1997 Frattini
5,692,542 A 12/1997 Smith
5,799,351 A 9/1998 Rief et al.
5,933,899 A 8/1999 Campbell et al.
D417,047 S 11/1999 Tsuda
D418,640 S 1/2000 Veloskey et al.
D421,512 S 3/2000 Campbell
D429,393 S 8/2000 Rief et al.
6,094,764 A * 8/2000 Veloskey ..... E04H 4/1654 15/1.7
6,115,864 A 9/2000 Davidsson et al.
6,131,227 A 10/2000 Rief et al.
D433,545 S 11/2000 Hollinger et al.
6,155,657 A 12/2000 Erlich et al.
6,187,181 B1 2/2001 Stoltz et al.
6,199,237 B1 3/2001 Budden
6,212,725 B1 4/2001 Porat
6,237,175 B1 5/2001 Phillipson et al.
D443,737 S 6/2001 Rief et al.
D444,280 S 6/2001 Rief et al.
D445,225 S 7/2001 Schaub
6,289,918 B1 9/2001 Rief et al.
6,292,970 B1 9/2001 Rief et al.
6,298,513 B1 10/2001 Rief et al.
D456,101 S 4/2002 Lee
6,460,564 B1 10/2002 Rief et al.
6,473,927 B1 11/2002 Sommer
D469,589 S 1/2003 Wichmann et al.
D471,330 S 3/2003 Campbell
6,560,808 B2 5/2003 Phillipson et al.
6,564,417 B2 5/2003 Porat
6,665,900 B2 12/2003 Wichmann et al.
6,691,811 B2 2/2004 Damrath
6,706,175 B1 3/2004 Rief et al.
D489,150 S 4/2004 Campbell
6,716,348 B1 4/2004 Morgan
6,733,046 B1 5/2004 Rief
6,782,578 B1 8/2004 Rief et al.
6,820,297 B2 11/2004 Phillipson et al.
6,854,148 B1 2/2005 Rief et al.
6,886,205 B1 5/2005 Pichon
6,942,790 B1 9/2005 Dolton
6,954,960 B2 10/2005 Pichon
D521,696 S 5/2006 Choi
7,060,182 B2 6/2006 Erlich et al.
7,117,554 B2 10/2006 Pichon
7,118,632 B2 10/2006 Sumonthee
7,293,314 B2 11/2007 Henkin et al.
D575,915 S 8/2008 Dreyer
D580,114 S 11/2008 Rummel
7,464,429 B2 12/2008 Stoltz
7,506,770 B2 3/2009 Rief
7,520,282 B2 4/2009 Stoltz
D594,610 S 6/2009 Klimas
D599,967 S 9/2009 Blanc-Tailleur
7,805,792 B2 10/2010 Roumagnac
7,849,547 B2 12/2010 Erlich et al.
7,908,697 B2 3/2011 Lavabre et al.
7,945,981 B2 5/2011 Lapping
8,168,065 B1 5/2012 Gavigan et al.
D670,462 S 11/2012 Mastio et al.
8,307,485 B2 11/2012 Sumonthee
8,341,789 B2 1/2013 Garti
8,402,585 B2 3/2013 Rief et al.
8,402,586 B2 3/2013 Lavabre
8,424,142 B2 4/2013 Garti
D684,738 S 6/2013 Richiuso et al.
8,459,384 B2 6/2013 Niederberger
8,474,081 B2 7/2013 Stoltz
8,561,240 B2 10/2013 Hui
8,590,090 B2 11/2013 Porat et al.
8,784,652 B2 7/2014 Rief et al.
8,869,337 B2 10/2014 Sumonthee
D721,460 S 1/2015 Hanan et al.
D728,873 S 5/2015 Renaud et al.
D730,598 S 5/2015 Meyer et al.
9,032,575 B2 5/2015 Sebor et al.
D733,374 S 6/2015 Richiuso et al.
9,145,699 B2 9/2015 Ben-Dov et al.
D747,573 S 1/2016 Richiuso et al.
9,328,525 B2 5/2016 Shlomi-Shlomi et al.
D787,761 S 5/2017 Mainville et al.
D788,860 S 6/2017 Kalogiros et al.
9,675,913 B1 6/2017 Sebor et al.
9,885,194 B1 2/2018 Hayes et al.
10,036,175 B2 7/2018 Sebor et al.
10,138,646 B2 11/2018 Garti et al.
10,145,137 B2 12/2018 Sebor et al.
10,167,650 B2 1/2019 Torem et al.
10,221,584 B2 3/2019 Hui et al.
10,246,894 B2 4/2019 Deloche et al.
10,407,930 B2 9/2019 Renaud et al.
10,425,903 B2 9/2019 Abdelmonem et al.
10,584,507 B2 3/2020 Sebor et al.
10,851,558 B2 12/2020 Bruneel
2003/0224889 A1 12/2003 Luh
2004/0074024 A1 4/2004 Bavoso
2004/0181884 A1* 9/2004 Phillipson ..... E04H 4/1663 15/1.7
2005/0035021 A1 2/2005 Higer et al.
2006/0143841 A1 7/2006 Niewiarowski
2008/0092322 A1 4/2008 Halle et al.
2008/0222821 A1 9/2008 Pichon
2008/0237103 A1 10/2008 King
2008/0244842 A1 10/2008 Lavabre et al.
2008/0283456 A1 11/2008 Charlotin
2009/0229061 A1 9/2009 Stoltz et al.
2009/0300862 A1* 12/2009 Schneider ..... E04H 4/1654 15/1.7
2010/0299863 A1 12/2010 Dewing
2011/0088181 A1 4/2011 Rief et al.
2011/0154585 A1 6/2011 Mastio et al.
2011/0154586 A1 6/2011 Mastio et al.
2011/0258789 A1 10/2011 Lavabre
2011/0314617 A1 12/2011 Van Der et al.
2012/0060307 A1 3/2012 Stoltz
2012/0144605 A1 6/2012 Dewings
2012/0210527 A1 8/2012 Erlich et al.
2013/0000677 A1 1/2013 Sumonthee
2013/0031729 A1 2/2013 Bernini
2013/0031734 A1 2/2013 Porat et al.
2013/0152316 A1 6/2013 Rief et al.

(56) References Cited

U.S. PATENT DOCUMENTS

| | | | | |
|---|---|---|---|---|
| 2014/0115796 | A1* | 5/2014 | Sebor | E04H 4/1654 15/1.7 |
| 2015/0246304 | A1 | 9/2015 | Moessinger et al. | |
| 2015/0322684 | A1 | 11/2015 | Renaud | |
| 2016/0002941 | A1 | 1/2016 | Riedl | |
| 2016/0153210 | A1* | 6/2016 | Sebor | E04H 4/1654 15/1.7 |
| 2016/0207204 | A1 | 7/2016 | Teuscher et al. | |
| 2016/0230623 | A1 | 8/2016 | Lapoint | |

FOREIGN PATENT DOCUMENTS

| | | | |
|---|---|---|---|
| CN | 102372359 | B | 11/2012 |
| DE | 2904464 | A1 | 8/1979 |
| EP | 0465453 | A1 | 1/1992 |
| FR | 2584442 | A | 1/1987 |
| FR | 2925557 | A | 6/2009 |
| WO | 2011161389 | A1 | 12/2011 |

OTHER PUBLICATIONS

Pentair Leaf Trap Canister, installation and repair.wmv; https://www.youtube.com/watch?v=RHEtesUaQNM.

International Search Report dated May 5, 2021 for PCT/US21/18146.

* cited by examiner

AUTOMATIC POOL CLEANER

CROSS-REFERENCE TO RELATED APPLICATION

This claims the benefit of priority from U.S. Application No. 62/978,529, filed Feb. 19, 2020, which is incorporated by reference.

FIELD

This relates to the field of swimming pool cleaners and, more particularly, automatic pool cleaners.

BACKGROUND

Automatic pool cleaners are designed to move along submerged pool surfaces and remove debris similar to a vacuum cleaner. They may be powered by electricity, positive pressure, or suction. Unfortunately, electric and pressure-powered pool cleaners can be very expensive. Further, many pressure-powered pool cleaner require a second pump to be used to create sufficient pressure.

Suction pool cleaners have several advantages over electric and pressure-powered pool cleaners. Suction pool cleaners are usually much more simple to construct, making them less expensive to manufacture and easier to replace worn parts. And, because suction pool cleaners are powered by the same pump used to operate the pool, they do not require additional pool equipment.

BRIEF SUMMARY

A problem with suction pool cleaners is that they can get stuck on submerged obstacles such as drains and can also lose suction and cause the pool pump to air lock if they climb above the waterline of the pool.

A first example of the pool cleaner includes a drive mechanism operable to drive the pool cleaner along a submerged surface of a pool in a forward direction. A housing carried by the drive mechanism has a bottom with an inlet port that receives debris removed from the submerged surface. An outlet port is in fluid communication with the inlet port. A plenum is on the bottom for enhancing suction around the inlet port. A vent mechanism defining at least one opening through the housing is forward the outlet port. A water port defining at least one opening on the bottom is in fluid communication with the vent mechanism. When the forward end of the pool cleaner extends above the waterline of the pool, water flows through the vent mechanism and the water port over the plenum so as to prevent loss of suction at the inlet port.

This first example of the pool cleaner may include one or more of any of the following features.

The vent mechanism and water port may be positioned in such a way that the waterline passes through the vent mechanism and water port simultaneously.

The water port may be positioned forward the inlet port and directly under the vent mechanism.

The plenum may include a recessed area around the inlet port and the water port may be positioned forward the recessed area.

The plenum may include a forward retractable member extending laterally across the bottom and forward the inlet port and the water port may be positioned directly vertical above the forward retractable member.

The vent mechanism may be at least partially positioned forward the outlet port while the plenum includes a forward retractable member extending laterally across the bottom and forward the inlet port. The water port is positioned directly vertical above the forward retractable member and directly under the vent mechanism.

A drive mechanism may be operable to drive the pool cleaner along the submerged surface of a pool in the forward direction and a turning direction using a drive train having a pinion gear that operably mates with a wheel gear on a wheel of the drive mechanism. A cam is operable with the pinion gear and includes a radially enlarged and a radially constricted section arranged about a circumference of the cam. A drive shaft contactor is connected to the pinion gear and cam in such a way that the pool cleaner changes between moving in the forward direction and turning direction when the drive shaft contactor contacts the radially enlarged or the radially constricted section of the cam. The drive shaft contactor is spring biased against the cam about a rotational axis passing through the drive shaft contactor.

The pool cleaner may further include a forward retractable member extending laterally across the bottom and forward the inlet port, a rear retractable member extending laterally across the bottom and rearward the inlet port, and a protruding member extending downwardly from a plenum top surface and longitudinally between the forward retractable member and rear retractable member. When the pool cleaner drives over a submerged obstacle, the protruding member contacts the submerged obstacle and tilts the pool cleaner to prevent the pool cleaner from becoming stuck on the submerged obstacle.

A second example of the pool cleaner includes a drive mechanism operable to drive the pool cleaner along a submerged surface of a pool in a forward direction. A housing carried by the drive mechanism has a bottom with an inlet port that receives debris removed from the submerged surface. An outlet port is in fluid communication with the inlet port. A plenum is on the bottom for enhancing suction around the inlet port. A forward retractable member extends laterally across the bottom and forward the inlet port. A rear retractable member extends laterally across the bottom and rearward the inlet port. A protruding member extends downwardly from a plenum top surface and longitudinally between the forward retractable member and rear retractable member. When the pool cleaner drives over a submerged obstacle, the protruding member contacts the submerged obstacle and tilts the pool cleaner to prevent the pool cleaner from becoming stuck on the submerged obstacle.

This second example of the pool cleaner may include one or more of any of the following features.

When a forward end of the pool cleaner extends above a waterline of the pool, water flows through a vent mechanism and a water port of the housing and over the plenum so as to prevent loss of suction at the inlet port. The vent mechanism and water port are positioned on the housing in such a way that the waterline passes through the vent mechanism and water port simultaneously.

The plenum may include a forward vertical wall forward the inlet port and a rear vertical wall rearward the inlet port where the protruding member contacts the forward vertical wall and rear vertical wall.

The plenum may include a recessed area around the inlet port and the protruding member may extend downwardly out of the recessed area.

The pool cleaner may also include a vent mechanism defining at least one opening through a top of the housing and a water port defining at least one opening on the bottom. The water port is in fluid communication with the vent mechanism. When a forward end of the pool cleaner extends above a waterline of the pool, water flows through the vent mechanism and the water port over the plenum so as to prevent loss of suction at the inlet port.

The drive mechanism may be operable to drive the pool cleaner along the submerged surface of a pool in the forward direction and a turning direction using a drive train having a pinion gear that operably mates with a wheel gear on a wheel of the drive mechanism. A cam operable with the pinion gear includes a radially enlarged and a radially constricted section arranged about a circumference of the cam. A drive shaft contactor is connected to the pinion gear and cam in such a way that the pool cleaner changes between moving in the forward direction and turning direction when the drive shaft contactor contacts the radially enlarged or the radially constricted section of the cam. The drive shaft contactor is spring biased against the cam about a rotational axis passing through the drive shaft contactor.

A third example of the pool cleaner includes a drive mechanism operable to drive the pool cleaner along a submerged surface of a pool in a forward direction and a turning direction using a drive train having a pinion gear that operably mates with a wheel gear on a first wheel of the drive mechanism. A housing carried by the drive mechanism has a bottom with an inlet port that receives debris removed from the submerged surface. An outlet port is in fluid communication with the inlet port. A cam operable with the pinion gear includes a radially enlarged and a radially constricted section arranged about a circumference of the cam. A drive shaft contactor is connected to the pinion gear and cam in such a way that the pool cleaner changes between moving in the forward direction and turning direction when the drive shaft contactor contacts the radially enlarged or the radially constricted section of the cam. The drive shaft contactor is spring biased against the cam about a rotational axis passing through the drive shaft contactor.

This third example of the pool cleaner may include one or more of any of the following features.

When a forward end of the pool cleaner extends above a waterline of the pool, water flows through a vent mechanism and a water port of the housing and over a plenum on the bottom for enhancing suction around the inlet port so as to prevent loss of suction at the inlet port, the vent mechanism and water port being positioned on the housing in such a way that the waterline passes through the vent mechanism and water port simultaneously.

The pool cleaner may also include a plenum formed on the bottom for enhancing suction around the inlet port, a vent mechanism defining at least one opening through a top of the housing, and a water port defining at least one opening on the bottom. The water port is in fluid communication with the vent mechanism. When a forward end of the pool cleaner extends above a waterline of the pool, water flows through the vent mechanism and the water port over the plenum so as to prevent loss of suction at the inlet port.

The pool cleaner may also include a plenum formed on the bottom for enhancing suction around the inlet port, a forward retractable member extending laterally across the bottom and forward the inlet port, and a rear retractable member extending laterally across the bottom and rearward the inlet port. A protruding member extends downwardly from a plenum top surface and longitudinally between the forward retractable member and rear retractable member. When the pool cleaner drives over a submerged obstacle, the protruding member contacts the submerged obstacle and tilts the pool cleaner to prevent the pool cleaner from becoming stuck on the submerged obstacle.

The drive mechanism may include a track wrapped around the first wheel and a second wheel, the first wheel having a larger diameter than the second wheel.

The drive mechanism may include a track wrapped around the first wheel and a second wheel. The track, first wheel, and second wheel define a space therebetween. A guard substantially fills the space to prevent objects from entering the space.

DETAILED DESCRIPTION OF EXAMPLE EMBODIMENTS

Figure 1:
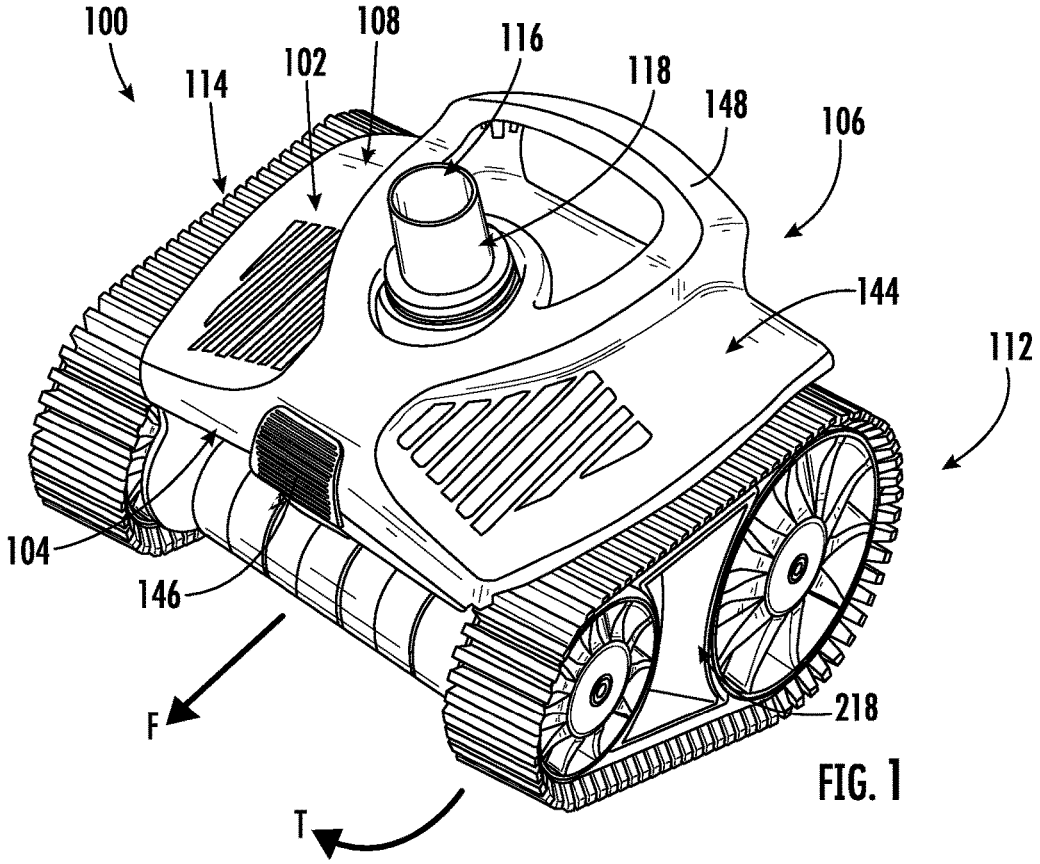
FIG. 1 is a perspective view from a forward end and top of an example of the pool cleaner.
Figure 2:
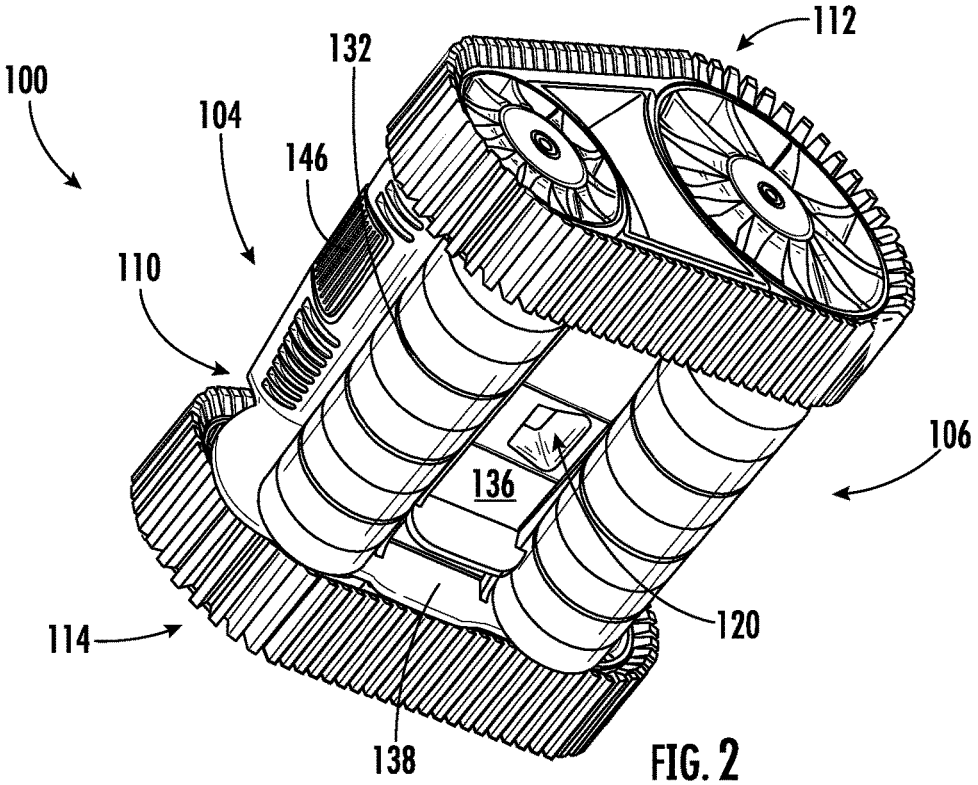
FIG. 2 is a perspective view from a forward end and bottom thereof.
Figure 3:
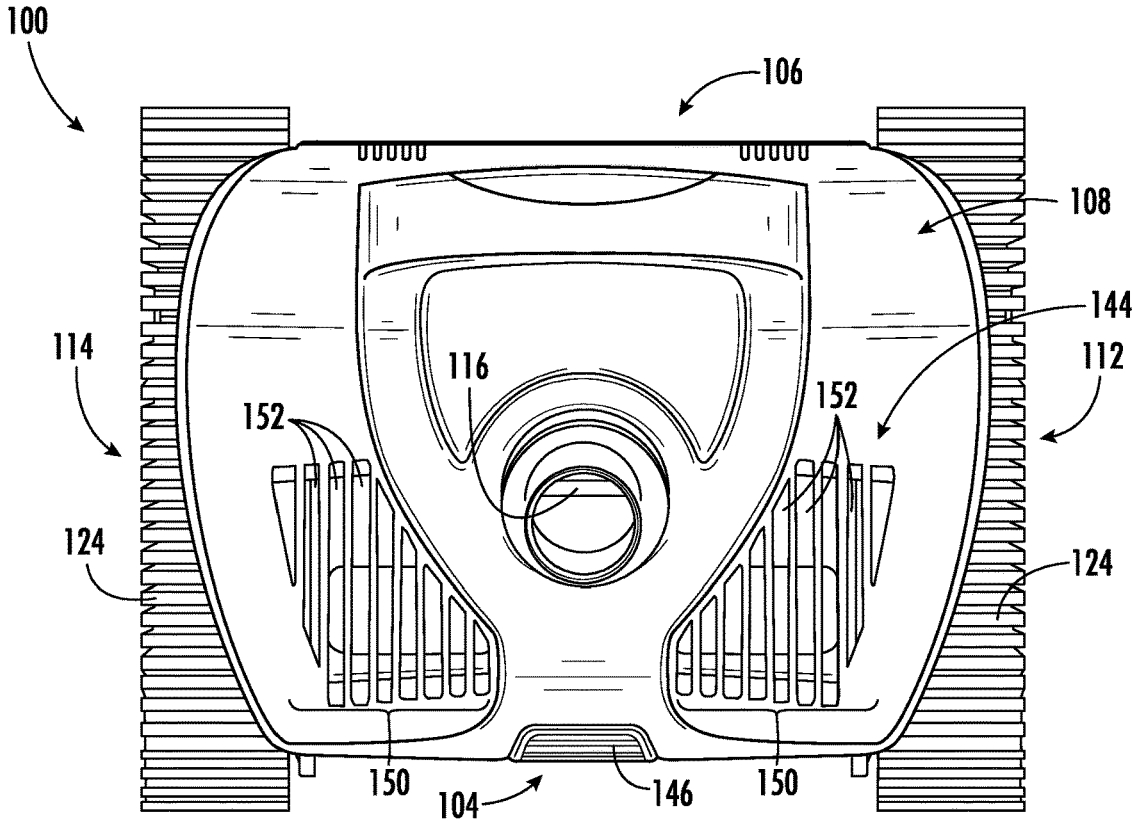
FIG. 3 is a top view thereof.
Figure 4:
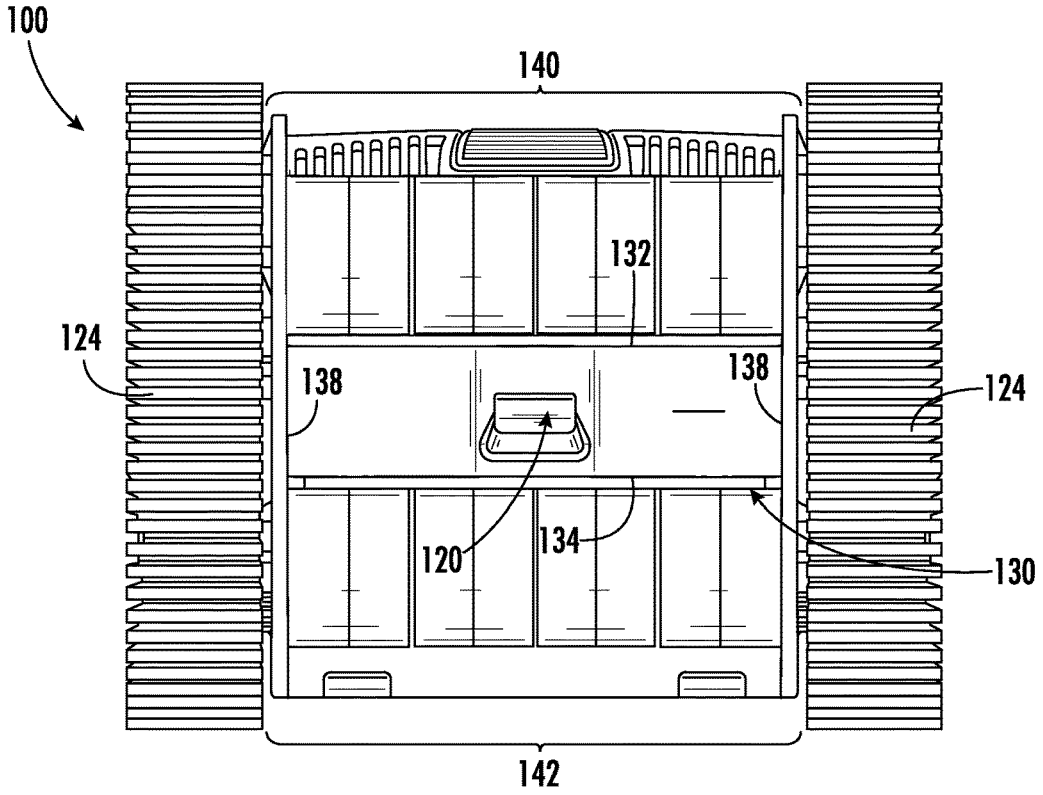
FIG. 4 is a bottom view thereof.
Figure 5:
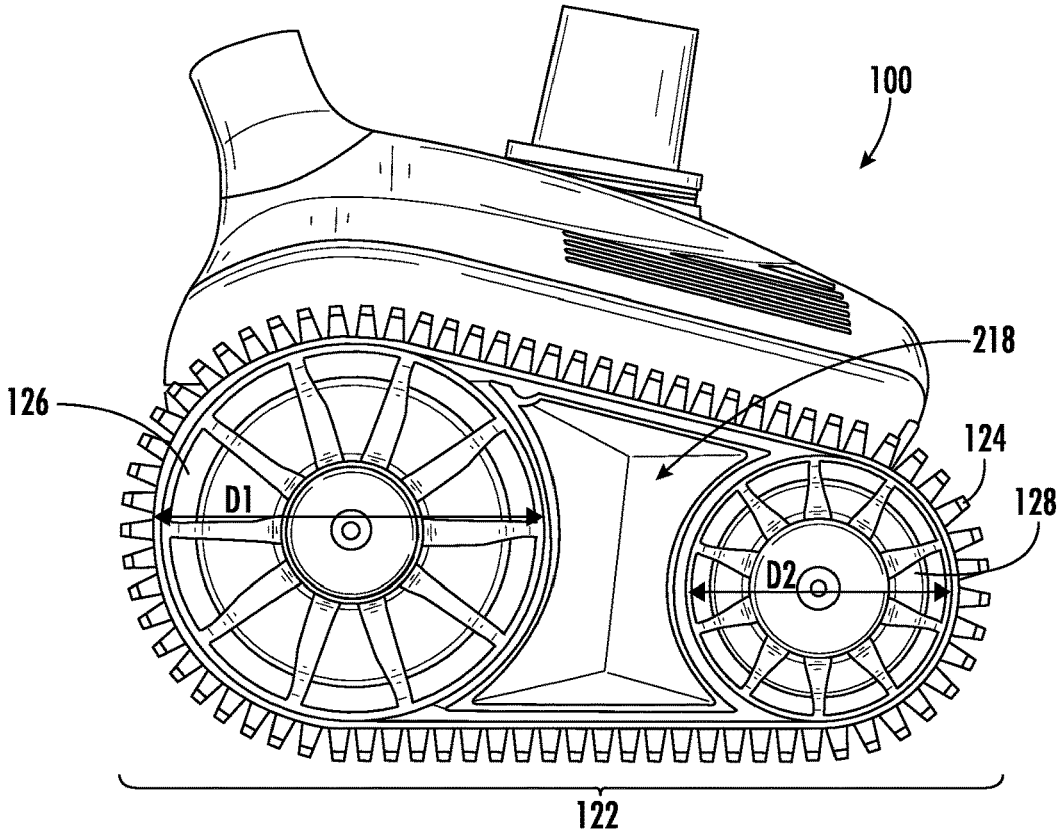
FIG. 5 is a side view thereof.
Figure 6:
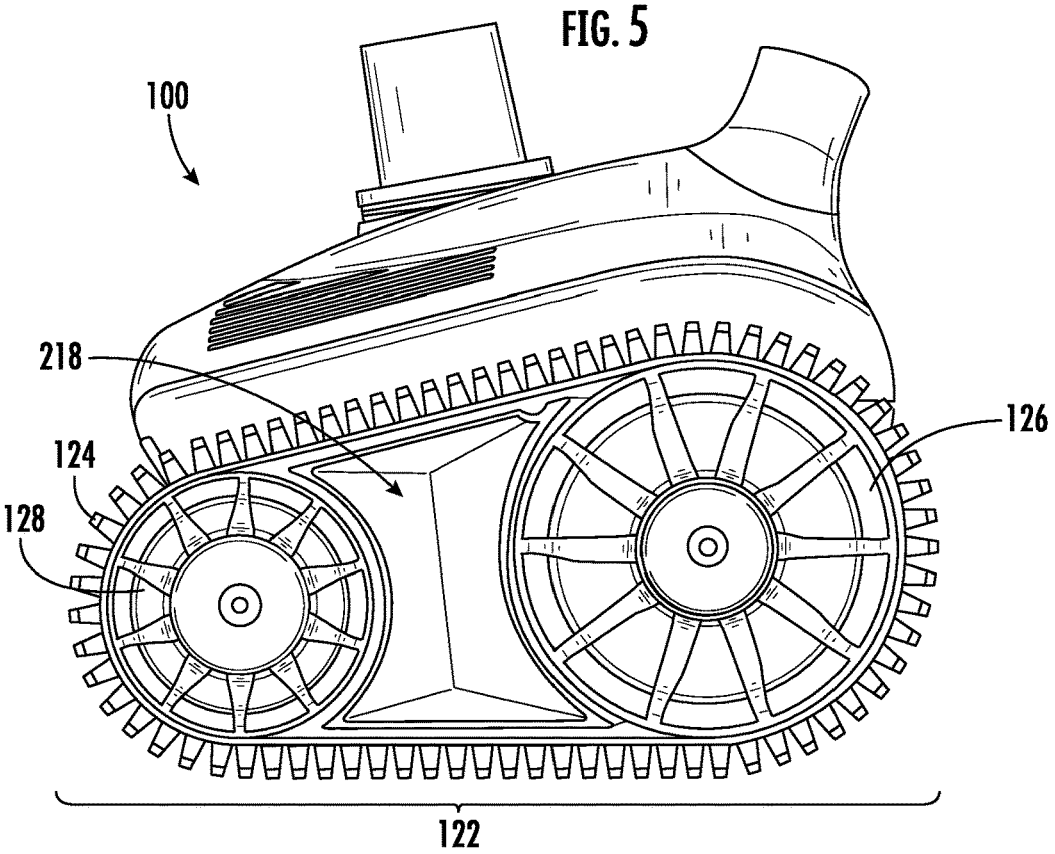
FIG. 6 is the opposite side view thereof.
Figure 7:
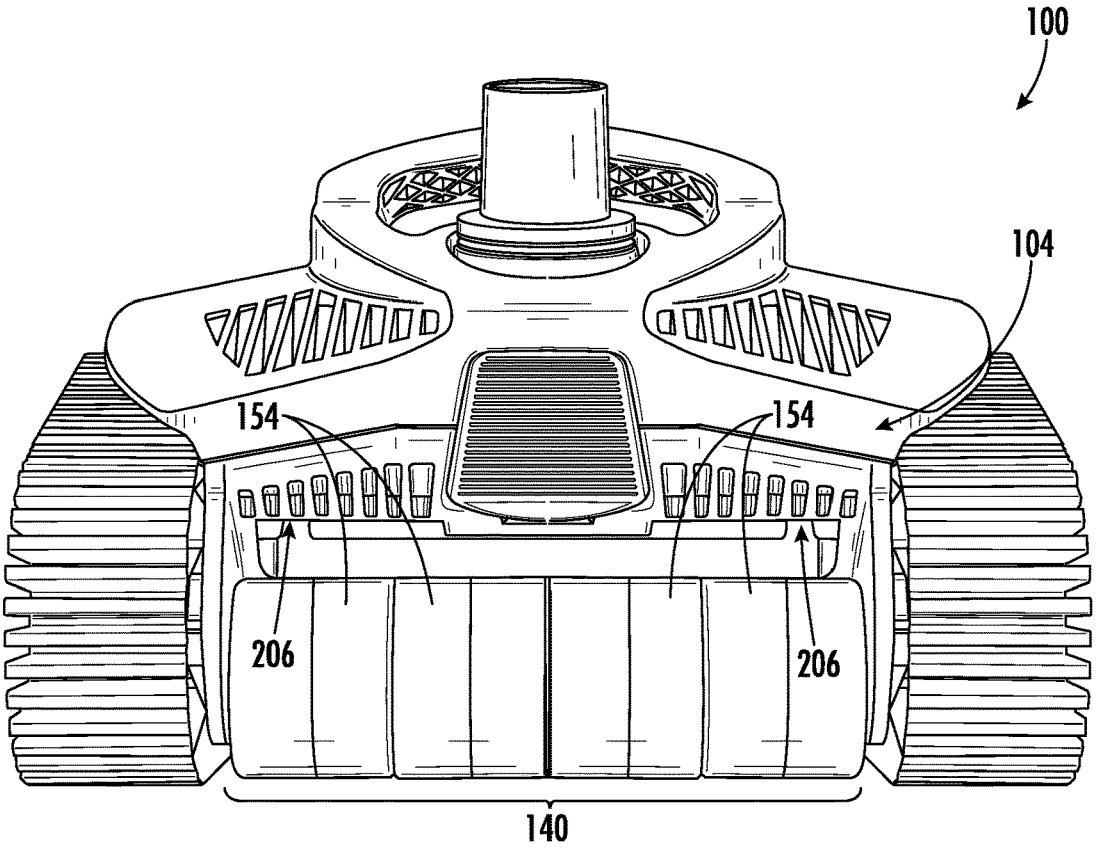
FIG. 7 is a forward end view thereof.
Figure 8:
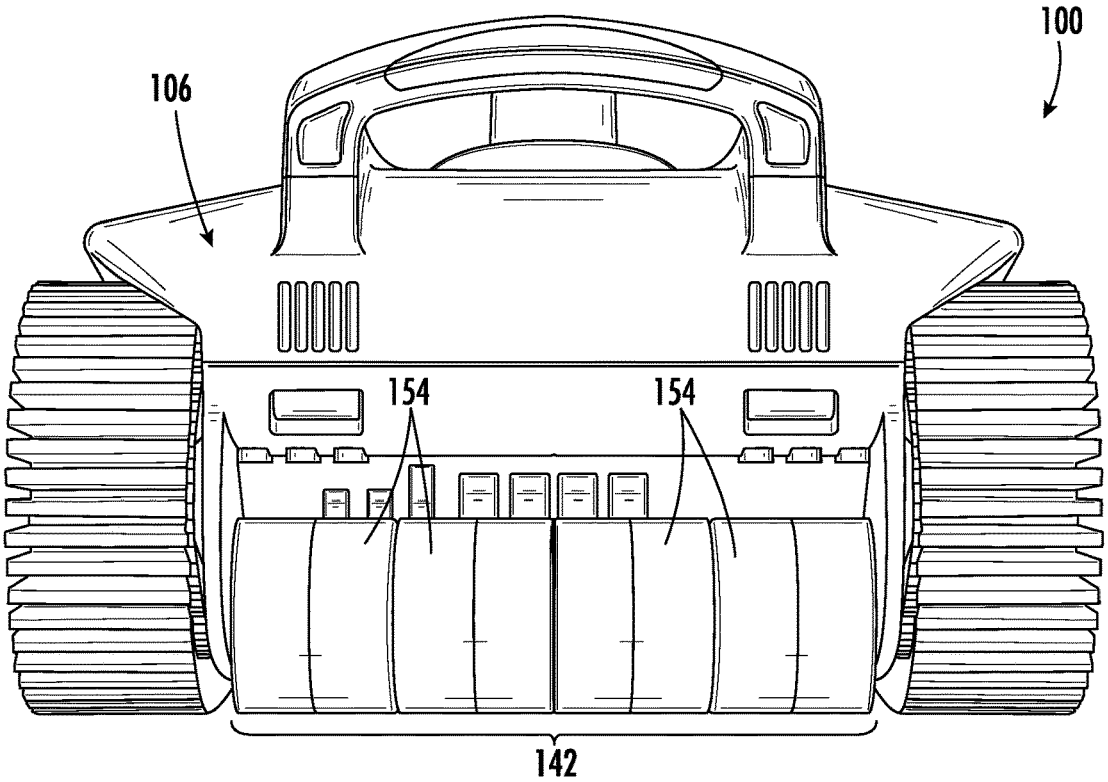
FIG. 8 is a back end view thereof.

This disclosure describes exemplary embodiments, but not all possible embodiments of the pool cleaner. Where a particular feature is disclosed in the context of a particular example, that feature can also be used, to the extent possible, in combination with and/or in the context of other examples. The pool cleaner and methods may be embodied in many different forms and should not be construed as limited to only the examples described here.

Referring initially to FIGS. 1-8, certain features of an example of the pool cleaner 100 are described. The pool cleaner 100 includes a housing 102 having a forward end 104, a rear end 106, a top 108, a bottom 110, a first side 112, and a second side 114. Extending from the top 108 is an outlet port 116 defined by an outlet port housing 118. The outlet port 116 is in fluid communication with an inlet port 120 defined on the bottom 110 of the housing 102.

When suction is applied at the outlet port 116 via a suction hose (not shown), water and debris from submerged pool surfaces are drawn through the inlet port 120 in order to clean the submerged surfaces. As will be explained later, such suction is also used to propel the pool cleaner 100 in a forward direction F and a turning direction T.

The first side 112 and second side 114 include a respect drive mechanism 122 in mechanical communication with the suction. The drive mechanism 122 drives the pool cleaner 100 in various directions across the pool surface, including across the pool bottom and up the pool side walls.

In the example shown in the drawings, the drive mechanism is a track drive mechanism 122 and includes a track 124 wrapped around a first wheel 126 and a second wheel 128. The first wheel 126 is positioned rearward of the second wheel 128. In the example shown, a diameter D1 of the first wheel 126 is enlarged relative to a diameter D2 of the second wheel 128. In other examples of the pool cleaner 100, the drive mechanism may employ wheels without tracks.

The bottom 110 of the pool cleaner 100 defines a plenum 130 that creates an area of suction around the inlet port 120. The plenum 130 includes a forward vertical wall 132 and a rear vertical wall 134 extending downwardly from a top plenum wall 136 and laterally between opposed plenum sidewalls 138. Together, the forward vertical wall 132, rear vertical wall 134, top plenum wall 136, and opposed plenum sidewalls 138 form a recessed area around the inlet port 120 that enhances suction from the inlet port 120 in the plenum 130.

The plenum 130 also includes a forward retractable member 140 and a rear retractable member 142. The forward retractable member 140 and rear retractable member 142 are configured to contact the pool surface and extend and retract vertically as they move across obstacles such as large debris or drains on the pool surface.

The top 108 includes a cover 144 that may be removed via a cover latch 146 to access mechanical components inside the housing 102. The cover 144 includes a handle 148 that allows a user to easily grab the pool cleaner 100 to remove it from the pool when necessary.

A particularly advantageous feature of the cover 144 is at least one vent mechanism 150 formed adjacent the forward end 104 of the pool cleaner 100. The vent mechanism 150 is configured to allow water from outside the housing 102 and cover 144 to flow into the housing 102 to help prevent loss of suction when the forward end 104 extends above the water line of the pool. The vent mechanism 150 may be composed of one or more holes defined by the cover 144 and extending completely through the cover 144. This advantageous feature is described in more detail later.

In the example shown in the drawings, the vent mechanism 150 includes a plurality of vent slits 152 formed on opposed sides of the inlet port 120. These vent slits 152 extend from a point proximal to the forward end 104 toward the rearward end 106 and do not extend past the position of the inlet port 120.

The vent mechanism 150 need not have the exact construction shown in the drawings or described above. The vent mechanism 150, in certain examples, is positioned proximal to the forward end 104, but does not necessarily have to be on the cover 144.

Figure 9:
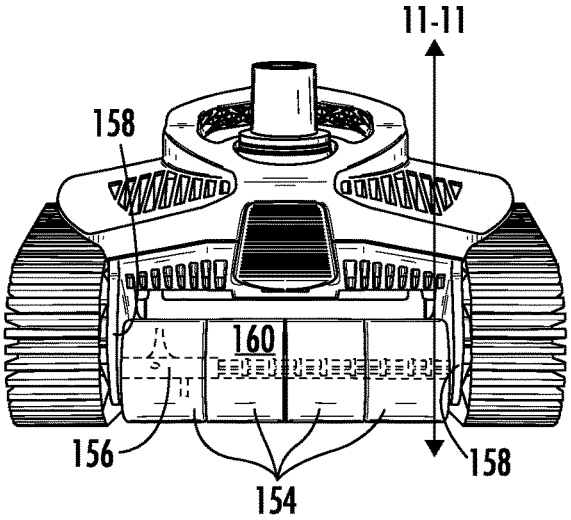
FIG. 9 is a front end view thereof with the forward retractable member shown as a transparent feature.
Figure 10:
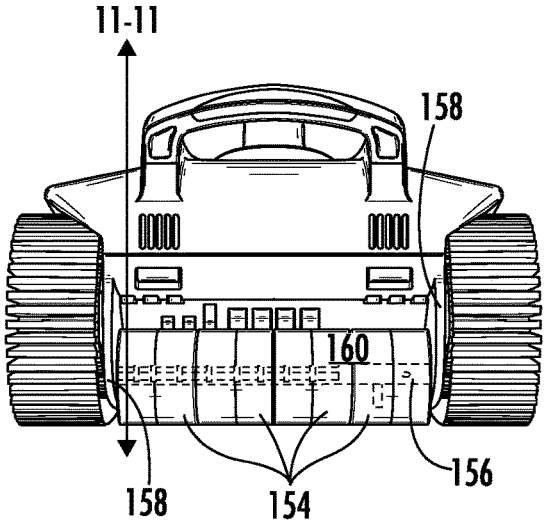
FIG. 10 is a back end view thereof with the rear retractable member shown as a transparent feature.
Figure 11:
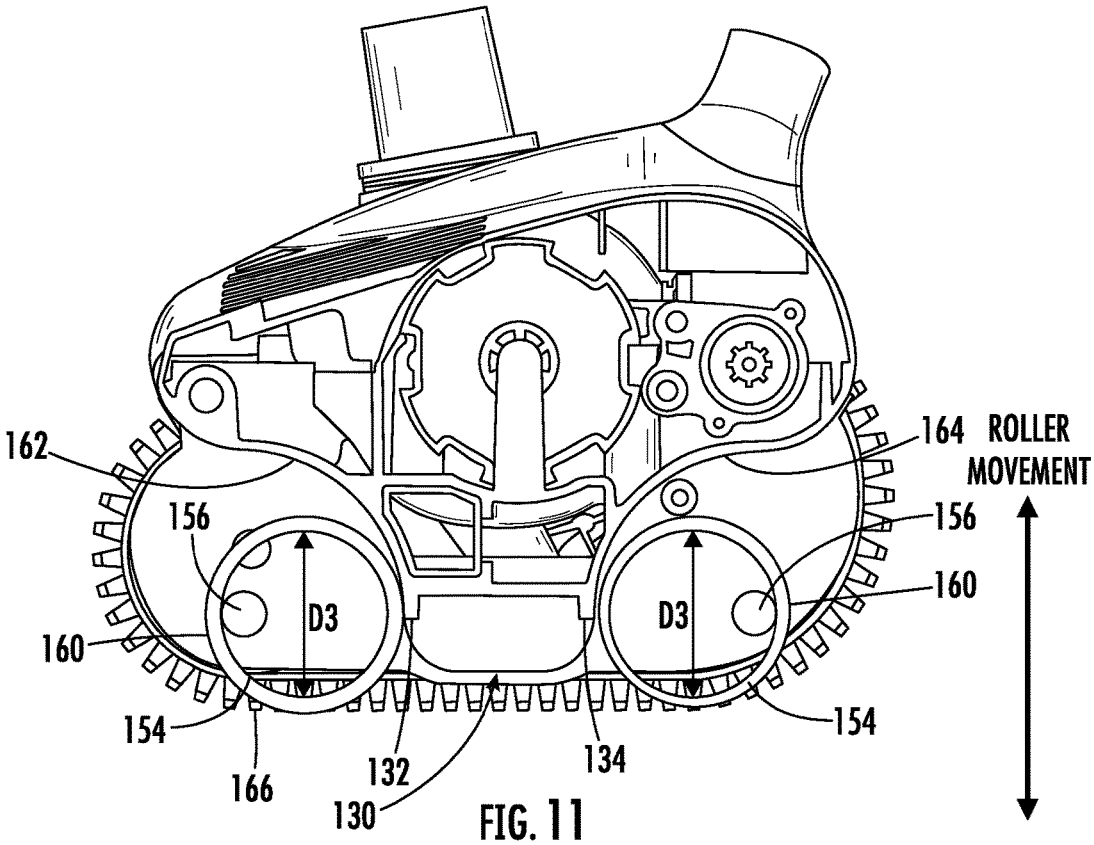
FIG. 11 is a cross-section view taken along plane 11-11 in FIGS. 9 and 10.

Referring now to FIGS. 9-11, additional details about the forward retractable member 140 and rear retractable member 142 will now be described. In FIGS. 9 and 10, the forward retractable member 140 and rear retractable member 142 are shown as transparent features so that their respective interiors are visible. FIG. 11 is a cross section taken along the plane 11-11 defined by the arrows in FIGS. 9 and 10.

In the example shown, both the forward retractable member 140 and rear retractable member 142 are composed of a plurality of substantially cylindrical rollers 154 that roll independently of one another about a support member 156 extending from opposed housing sidewalls 158. The rollers 154 have a diameter D3 selected so that an outer surface 160 of the rollers may slightly contact or almost contact a either a forward concave wall 162 or a rear concave wall 164 and the forward vertical wall 132 or the rear vertical wall 134 of the plenum 130. This construction allows each roller 154 to move independently of the other rollers 154 over obstacles on the pool surface and to help concentrate suction in the plenum 130.

The retractable members 140, 142 have a considerable range of movement. As illustrated by the arrows in FIG. 11, the outer surface 160 of the rollers 154 can extend beyond an outer perimeter 166 of the tracks 124.

The construction of the forward retractable member 140 and rear retractable member 142 is not limited to this example. For example, either or both of the forward retractable member 140 and rear retractable member 142 may be replaced with flaps instead of rollers. Likewise, the forward retractable member 140 and rear retractable member 142 may be composed of a single roller 154 or flap instead of a plurality of rollers 154 or flaps.

Figure 12:
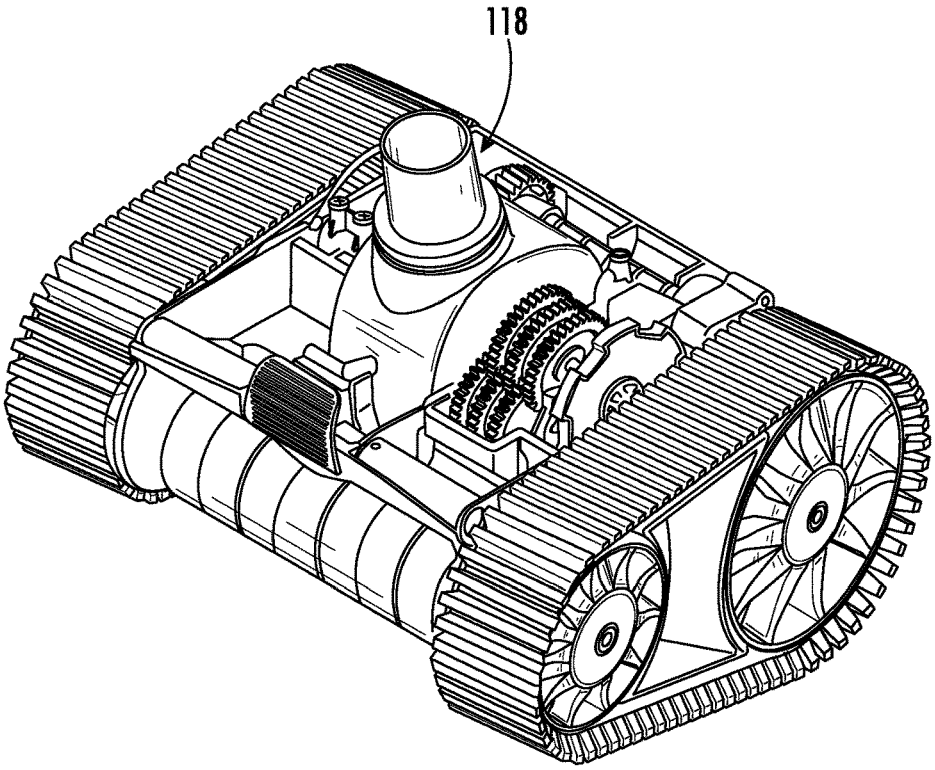
FIG. 12 is a similar view as in FIG. 1 with the cover removed.
Figure 13:
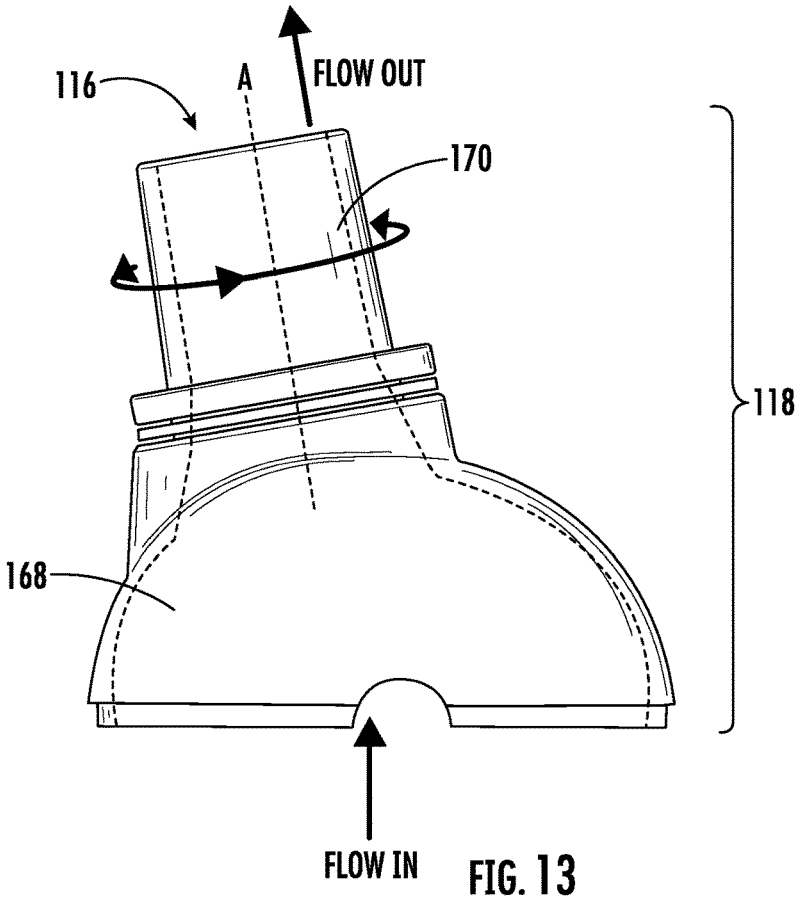
FIG. 13 is a side view of an example of the outlet port housing.

Referring to FIG. 12, the cover 144 has been removed so that the interior of the housing 102 is visible and details of the outlet port housing 118 can be described. FIG. 13 is a side view of the outlet port housing 118 with nonvisible features shown in dashed lines.

The outlet port housing 118 extends from the outlet port 116 at a top thereof to a turbine cover 168 at a bottom thereof. The turbine cover 168 is configured to cover the turbine described below and direct water flow from the turbine up through the outlet port 116. The outlet port 116 is defined by a hose nozzle 170 that is rotatable about an axis A passing through the cylindrical center of the hose nozzle 170. Making the hose nozzle 170 rotatable allows the pool cleaner 100 to turn without twisting the suction hose connected to the hose nozzle 170.

The inside of the outlet port housing 118, which is illustrated by dashed lines in FIG. 13 defines a water flow passage that directs water flow from the turbine 172 up through the outlet port 116.

Figure 14:
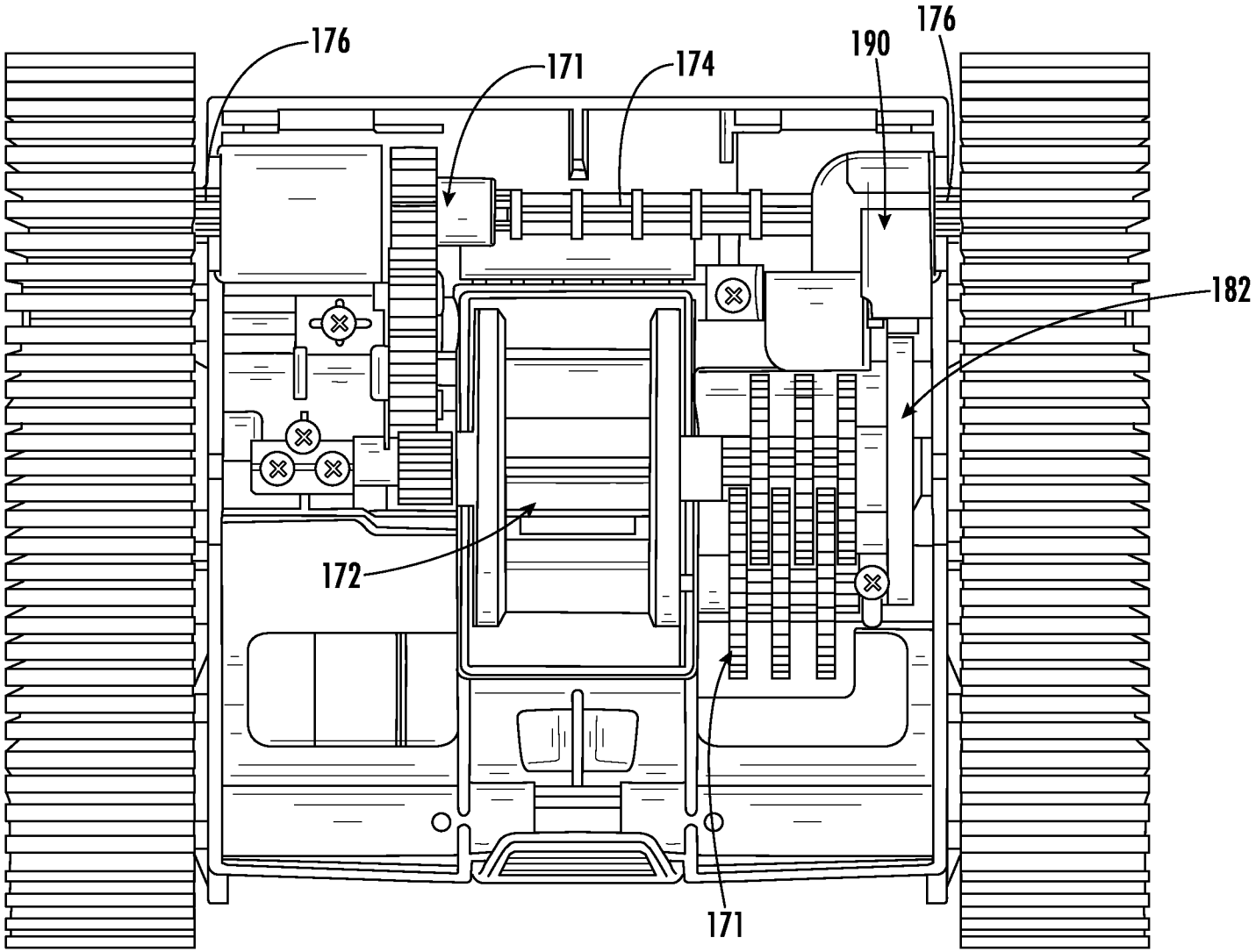
FIG. 14 is a top view of the pool cleaner with the cover and outlet port housing removed.
Figure 15:
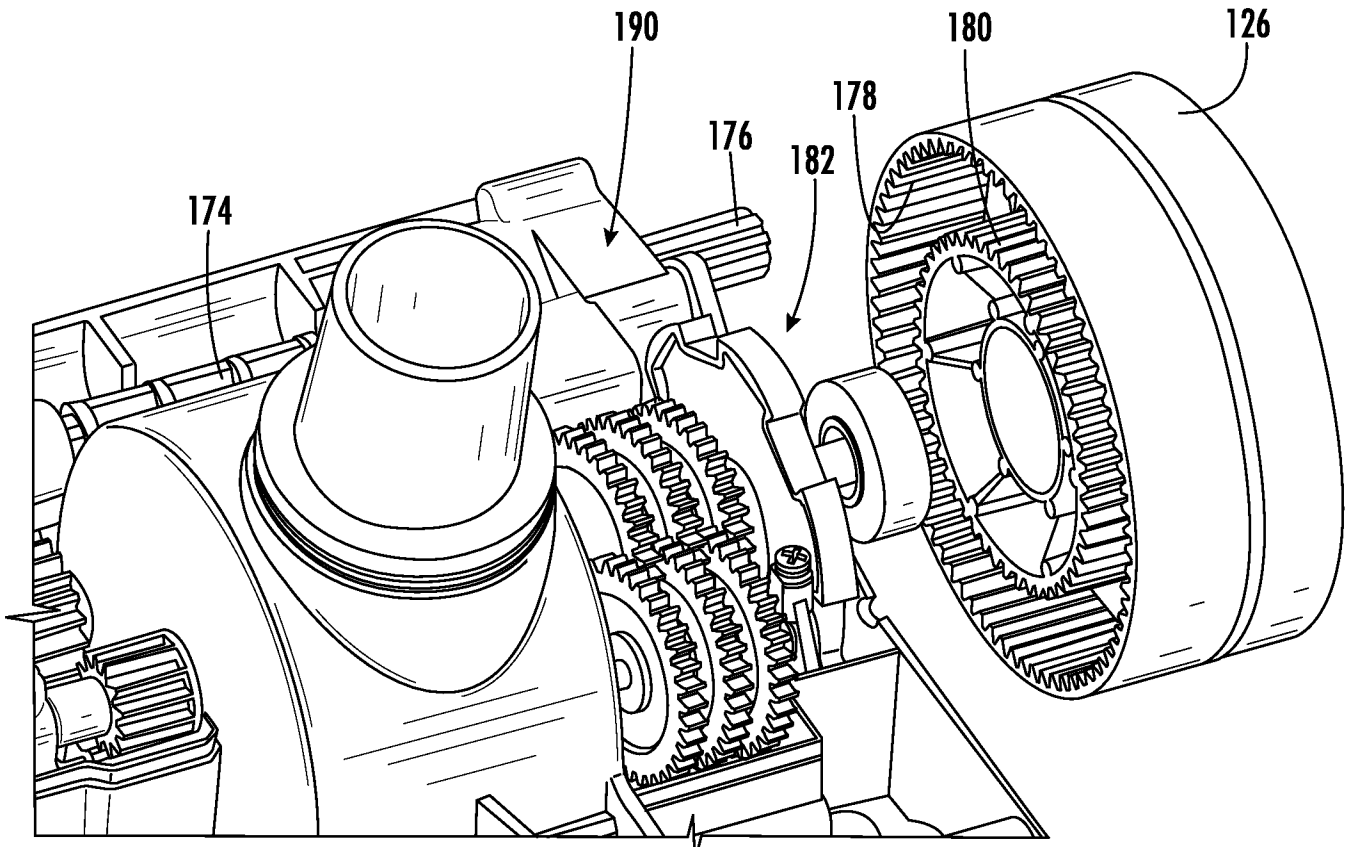
FIG. 15 is a partially exploded zoom view of a portion of the drive train.
Figure 16:
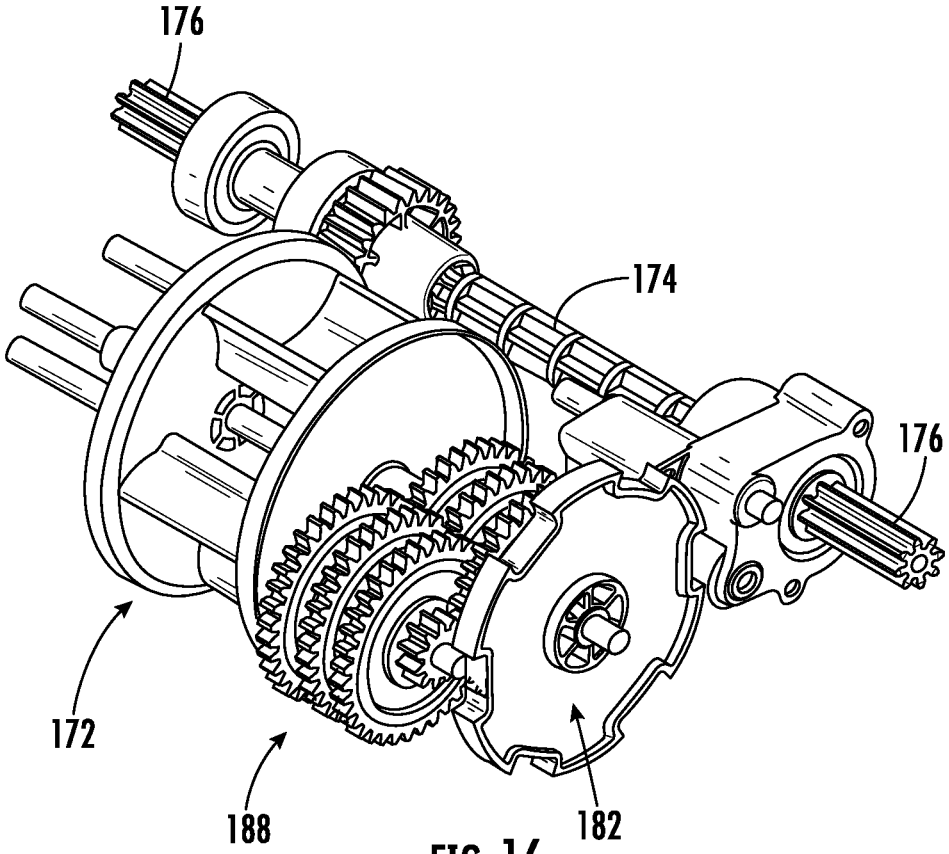
FIG. 16 is a side perspective view of the drive train.
Figure 17:
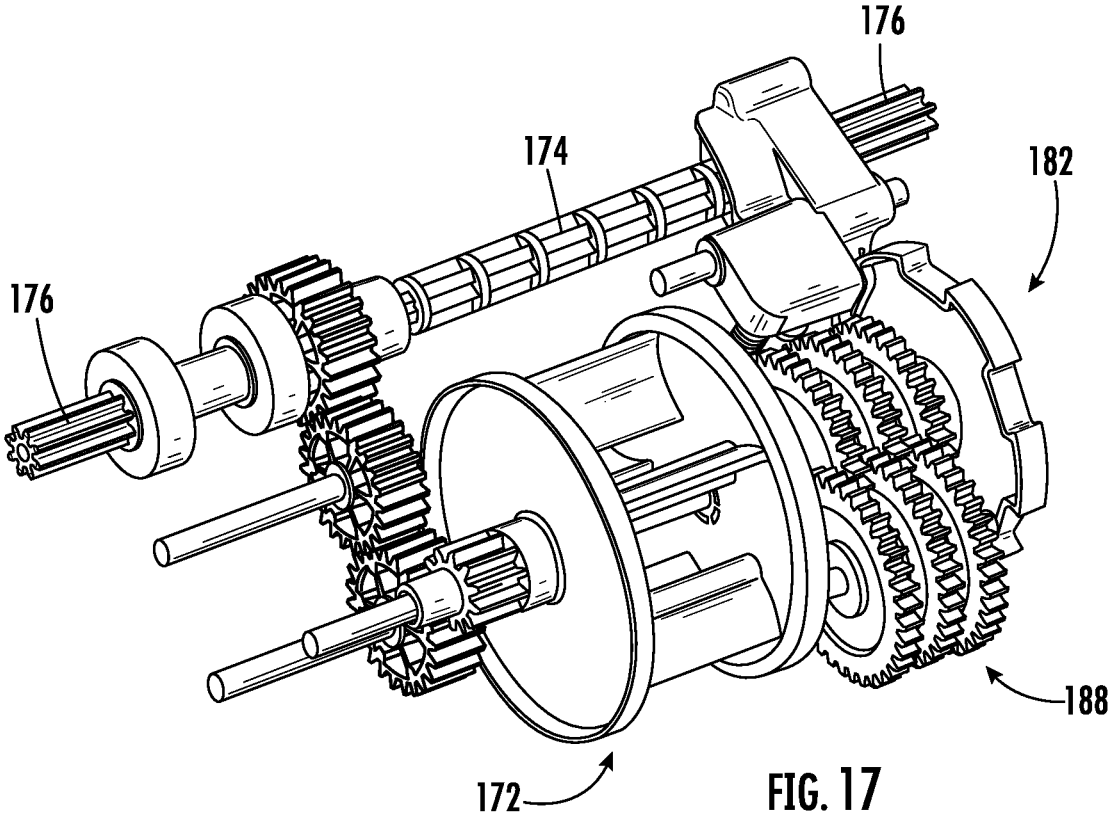
FIG. 17 is an opposite side perspective view of the drive train.

Referring to FIGS. 14 and 15, the pool cleaner 100 with the cover 144 removed and the outlet port housing 118 removed is shown so that details of the drive train 171 are visible. The drive train 171 is powered by suction that causes the turbine 172 to rotate. The motion of the spinning turbine 172 is transferred to at least one of the first wheels 126 via a plurality of gears in mechanical communication with a drive shaft 174 that causes the first wheels 126 to turn and power the drive mechanism 122 via a pinion gear 176.

In FIG. 15, the track 124 has been removed so that features of the inner side of first wheel 126 are visible. The first wheel 126 has a primary wheel gear 178 radially spaced from a secondary wheel gear 180 opposing one another on an inside peripheral surface of the first wheel 126.

The drive train 171 allows the pool cleaner 100 to move in the forward direction F and periodically make turns to so that the pool cleaner 100 can move to different areas of the pool. The steering operations are controlled by moving the drive shaft 174 so that the pinion gear 176 engages either the primary wheel gear 178 or the secondary wheel gear 180. When the pinion gear 176 engages the secondary wheel gear 180, the first wheel 126 moves in reverse, which causes the pool cleaner 100 to turn.

A cam 182 of the drive train 171 dictates whether the pool cleaner 100 moves in the forward direction F or turning direction T. In the turning direction T, the pool cleaner 100 changes direction relative to the forward direction F. Referring to FIGS. 16-19, the perimeter of the cam 182 includes alternating radially enlarged sections 184 and radially constricted sections 186. The cam 182 is rotated by the turbine 172 through use of reduction gears 188.

Figure 18:
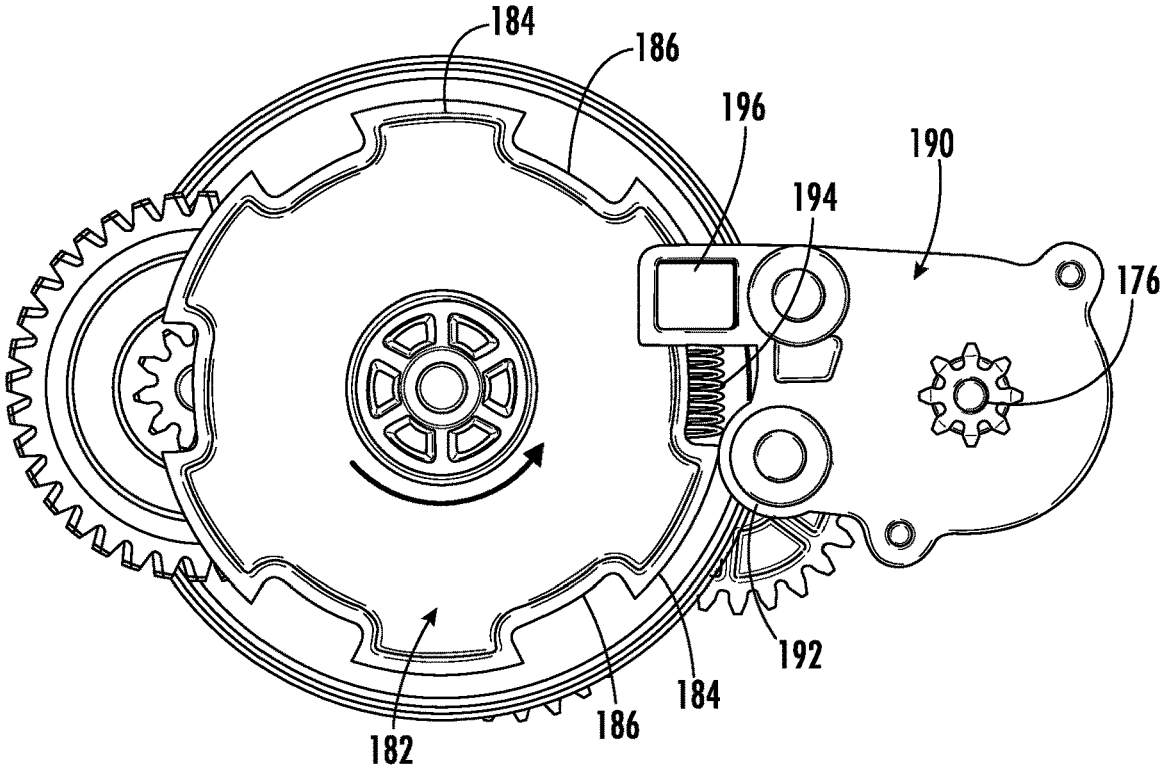
FIG. 18 is a side view of the drive train with the drive shaft contactor in a forward drive position.
Figure 19:
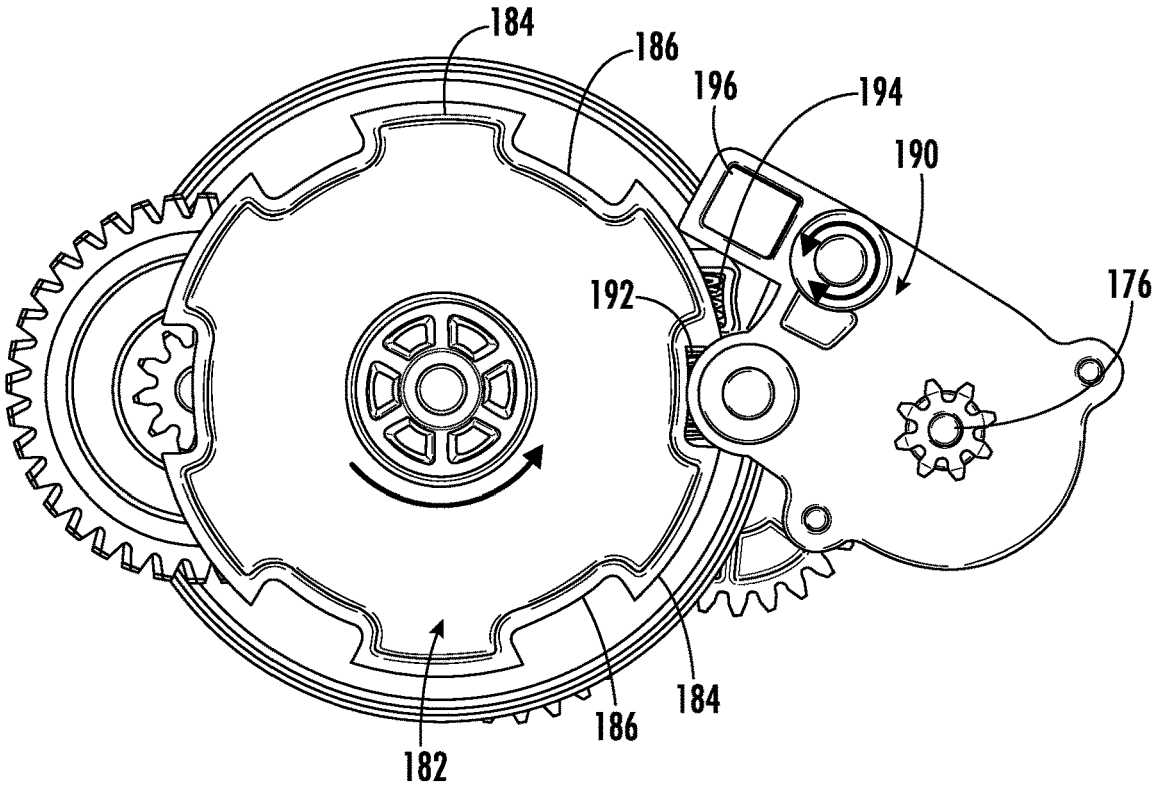
FIG. 19 is a side view of the drive train with the drive shaft contactor in a turning position.

A drive shaft contactor 190 mechanically connects the drive shaft 174 with the cam 182 and is operable to move the pinion gear 176 from a forward driving position to a turning position. In FIG. 18, the pinion gear 176 is in the forward driving position in which it engages the primary wheel gear 178. In FIG. 19, the pinion gear 176 is in the turning position in which it engages the secondary wheel gear 180.

The drive shaft contactor 190 includes a rotatable cam contacting member 192 that directly contacts the cam 182 and is biased against the cam 182 with at least one spring 194 or the like that presses upward against an arm 196. As shown in FIG. 18, when the cam contacting member 192 is in contact with a radially enlarged section 184 of the cam 182, the pinion 176 is in the forward driving position. As shown in FIG. 19, when the cam contacting member 192 is in contact with a radially constricted section 186 of the cam 182, the pinion 176 is biased by the spring 194 into the turning position.

A particularly advantageous feature of the pool cleaner 100 will now be described by referring to FIGS. 20 and 21 in which the retractable members 140, 142 have been removed from the pool cleaner 100 for better visibility of certain features. A problem with pool cleaners is that they sometimes become stuck on drain covers D raised above the pool surface S. The pool cleaner 100 described here is configured to substantially prevent itself from becoming stuck on submerged obstacles such as drain covers D by including a protruding member 198.

The protruding member 198 extends downwardly from the top plenum wall 136 and longitudinally between the forward vertical wall 132 and rear vertical wall 134. The protruding member 198 is positioned between the inlet port 120 and one of the plenum sidewalls 138. A terminal bottom end 200 of the protruding member 198 is positioned higher than a terminal bottom end 203 of the plenum sidewall 138. The forward surface 202 of the protruding member 198 tapers downwardly and rearwardly as it moves down from top plenum wall 136 to the terminal bottom end 200. The rear surface 204 of the protruding member 198 tapers upwardly and rearwardly as it moves up from the terminal bottom end 200 to the top plenum wall 136. This tapered shape allows the protruding member 198 to slide across surfaces easier than it otherwise would if the protruding member 198 were rectangular with sharp vertices.

Figure 20:
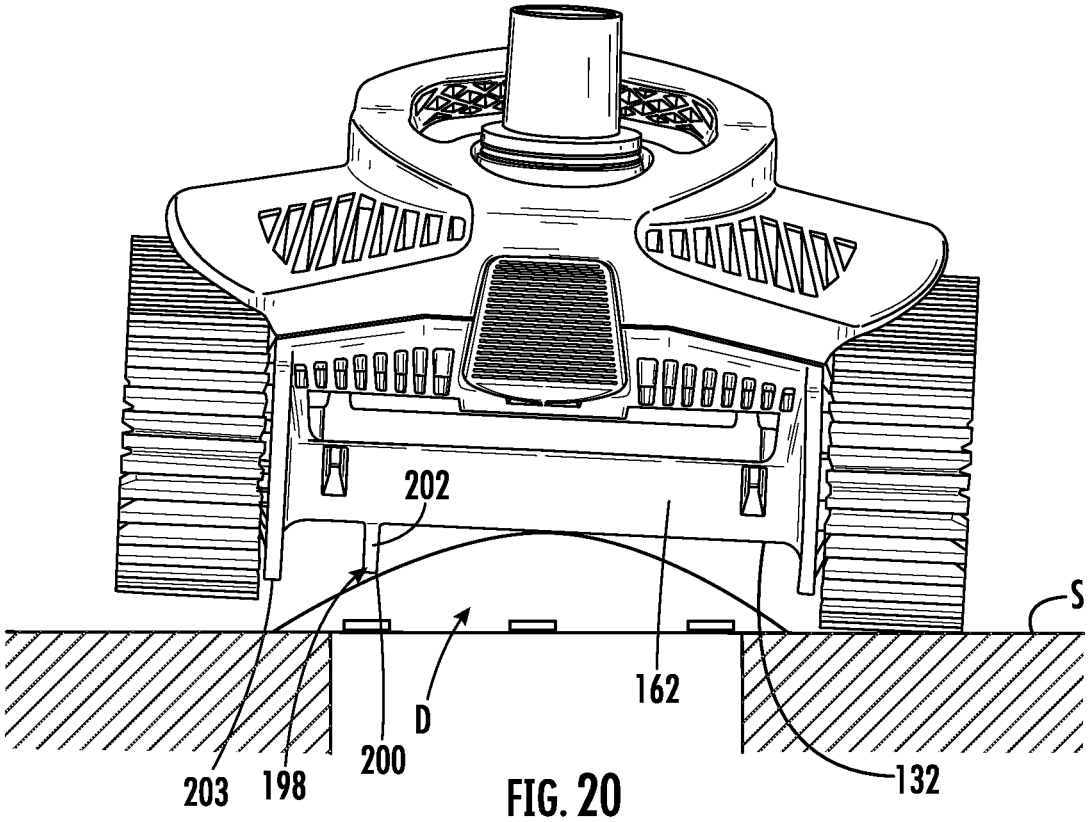
FIG. 20 illustrates how the protruding member can prevent the pool cleaner from becoming stuck on a pool drain. The forward and rear retractable members are removed for visibility of the protruding member.
Figure 21:
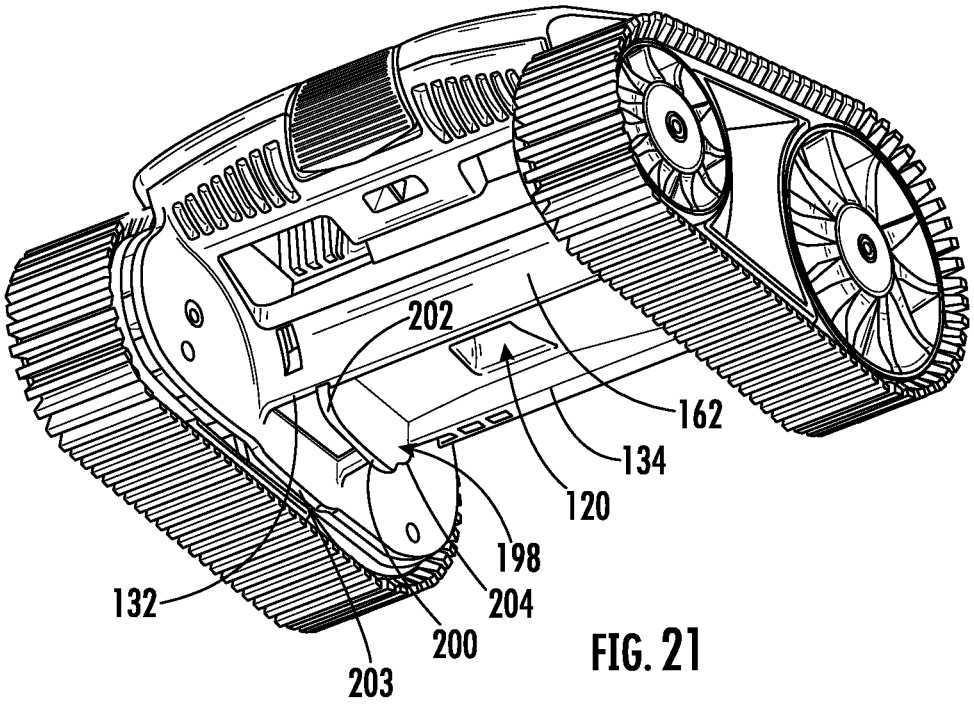
FIG. 21 is a bottom view with the forward and rear retractable members removed so that the protruding member is more visible.

As shown in FIG. 20, when the protruding member 198 contacts the drain cover D, it causes the pool cleaner 100 to tilt, which ensures at least one of the tracks 124 can maintain contact with the pool surface to prevent the pool cleaner 100 from getting stuck.

Figure 22:
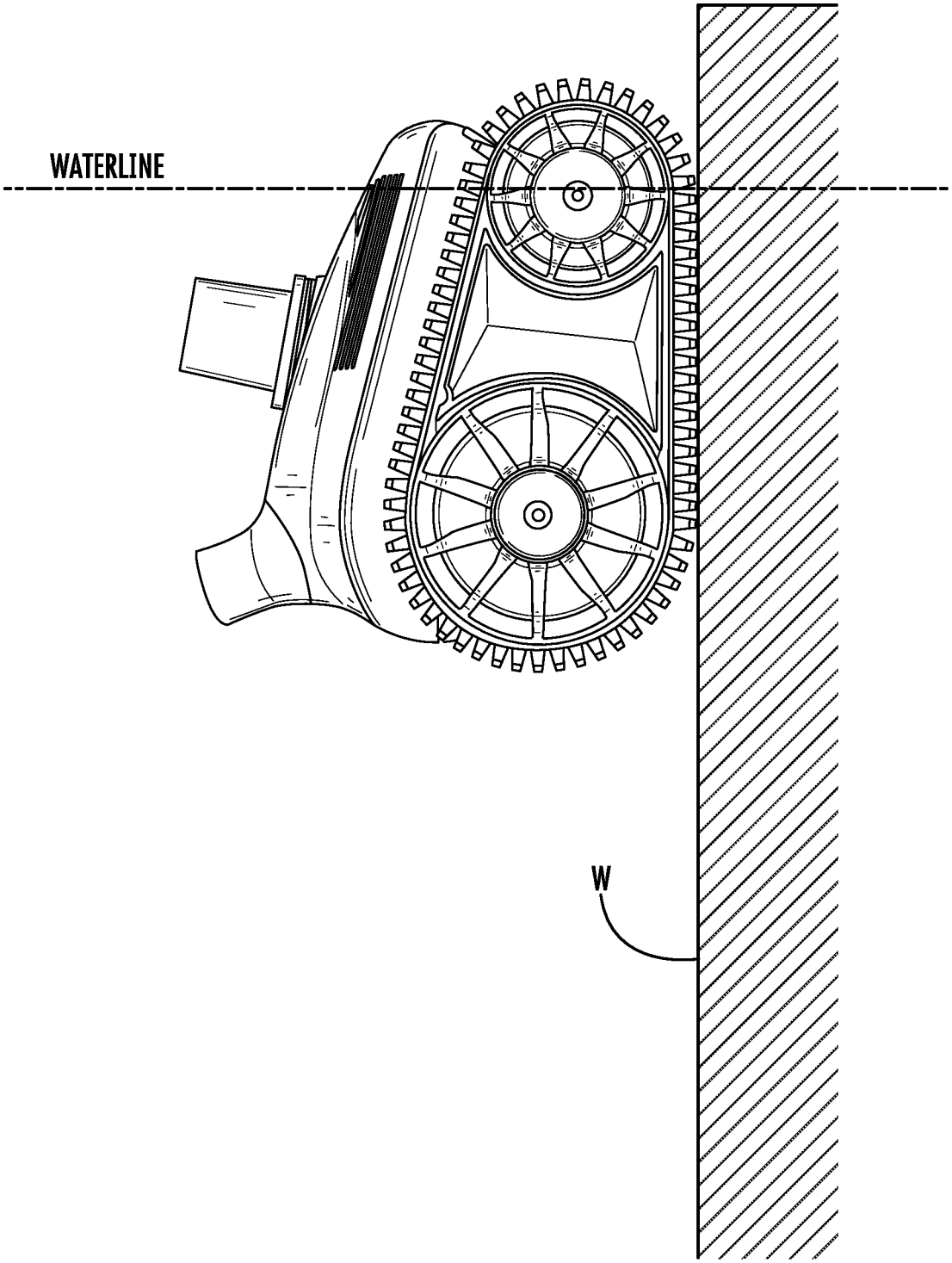
FIG. 22 illustrates the pool cleaner climbing a vertical wall of a pool and extending above the waterline.

Another advantageous feature of the pool cleaner 100 will now be described by referring to FIGS. 22-25. As illustrated in FIG. 22, when the pool cleaner 100 climbs vertical pool walls W, it can sometimes rise partially above the pool's waterline. When this happens to a conventional suction pool cleaner, the inlet port sucks in air, causing the pool cleaner to lose suction and temporarily stop working until suction is regained. The pool cleaner 100 described here is designed to prevent loss of suction in this situation.

Figure 23:
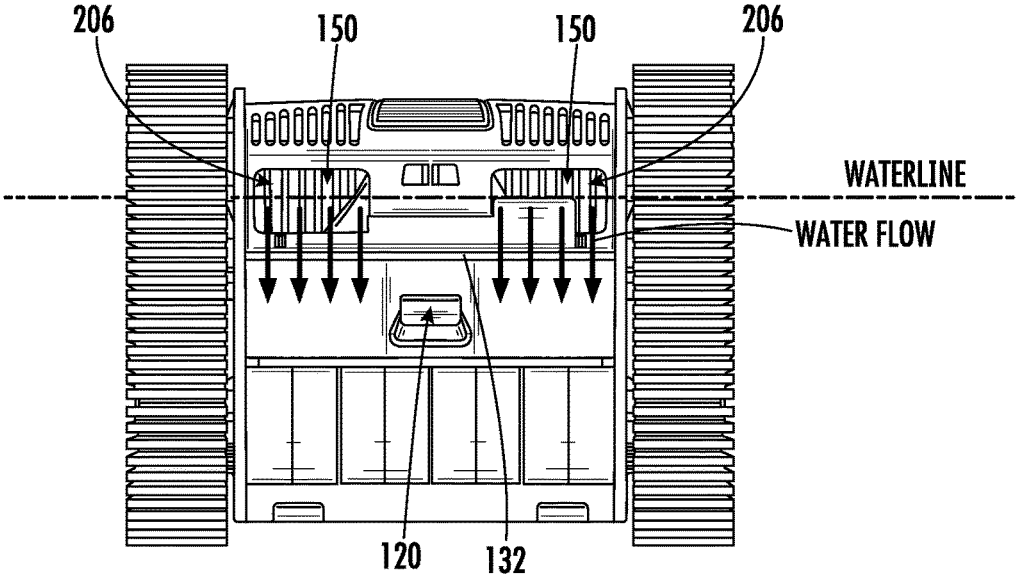
FIG. 23 is a bottom view of the pool cleaner with the forward retractable member removed to show the position of the water ports and the waterline in FIG. 22.
Figure 24:
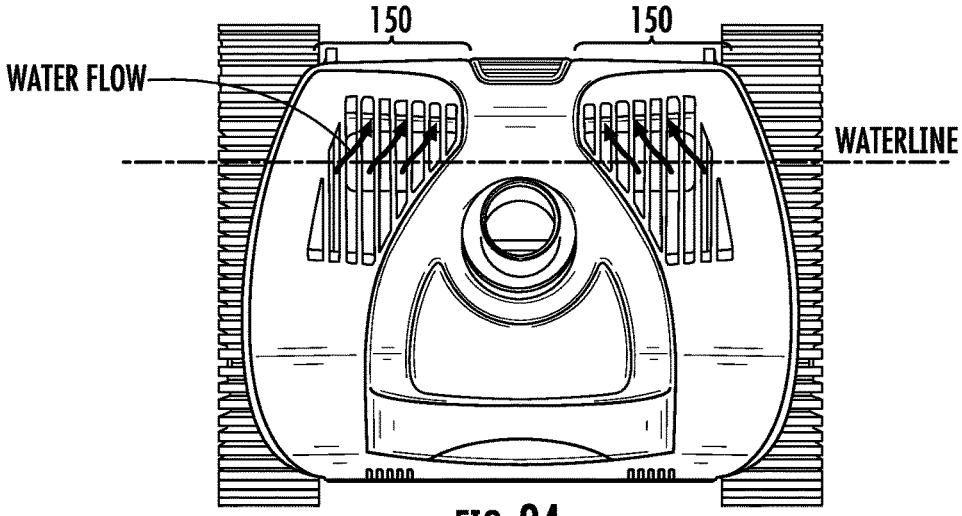
FIG. 24 is a top view of the pool cleaner indicating the position of the waterline in FIG. 22.
Figure 25:
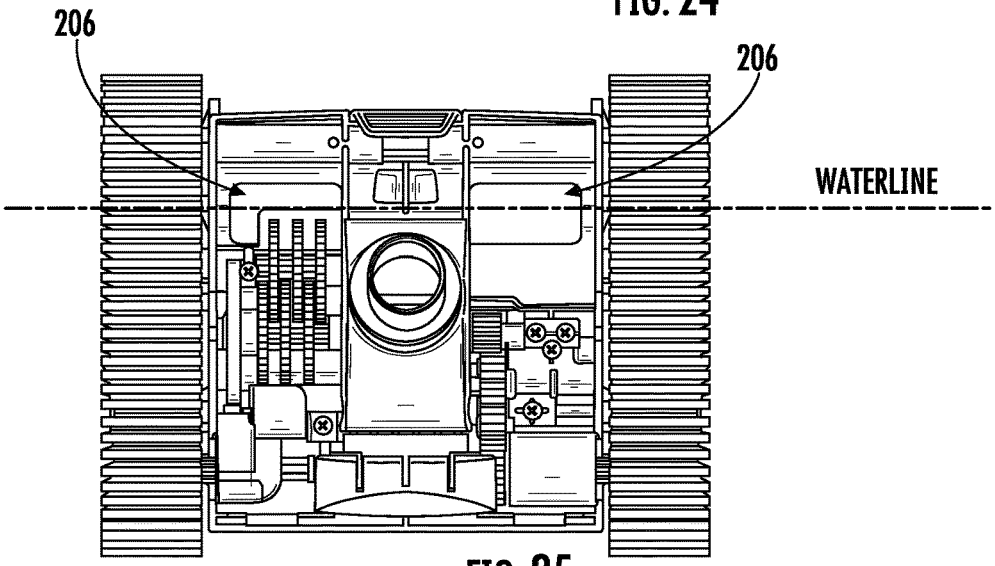
FIG. 25 is a top view of the pool cleaner with the cover removed and indicating the position of the waterline in FIG. 22.

FIGS. 22-25 indicate the position of the waterline on the pool cleaner 100 in FIG. 22 from different points of view. In FIGS. 23-25, the forward retractable member 140 has been removed for better visibility of certain features. In FIG. 25, the cover 144 has also been removed for better visibility of certain features.

Suction loss is prevented by water passing through the vent mechanism 150 through the housing 102 and out one or more water ports 206 formed on the bottom 110. This water then falls over the plenum 130 and substantially prevents loss of suction.

In the example shown, the water ports 206 are positioned directly beneath the vent mechanism 150 and forward from the forward vertical wall 132 closer to the forward end 104. The water ports 206 are also positioned directly above the forward retractable member 140 as can also be seen in FIG. 7. As used herein, the term "directly" means along the same vertical plane passing through the pool cleaner when it is in the orientation shown in FIGS. 5-8.

In the example shown, there are two water ports 206 positioned on either side of the inlet port 120. This permits water to flow across both sides of the plenum 130. In other examples, there may be one elongated water port 206 extending across both sides of the plenum 130 or there may more than two water ports 206 positioned about either side of the plenum 130.

Figure 26:
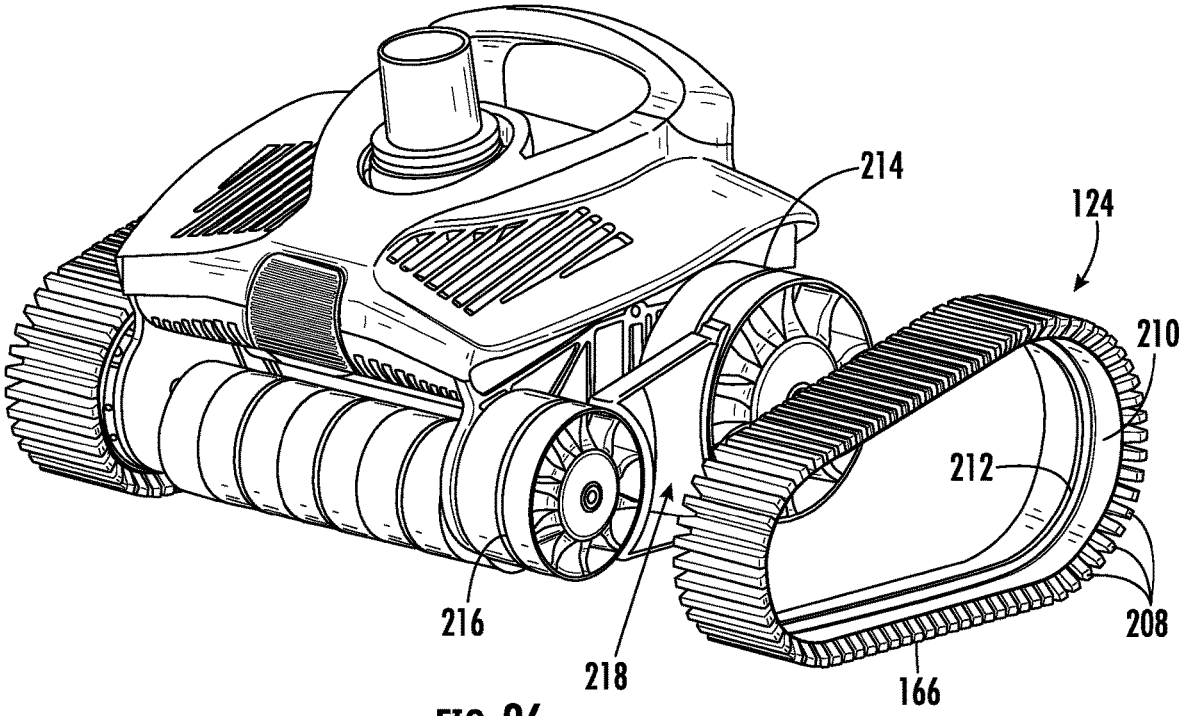
FIG. 26 is a side perspective view of the pool cleaner with one of the tracks removed.

Referring to FIG. 26, the track mechanism 122 construction will be described in more detail. The track 124 is made of flexible plastic or rubber material suitable for use on a pool cleaner. The outer perimeter 166 of the track 124 includes treads 208 for enhanced traction with the pool surface. An inner perimeter 210 of the track includes a raised ridge 212 extending substantially completely around the inner perimeter 210. The raised ridge 212 is sized to slide into a first groove 214 formed on a perimeter of the first wheel 126 and a second groove 216 formed on a perimeter of the second wheel 128. By making the raised ridge 212 mate with the first 214 and second 216 grooves, the track 124 is prevented from sliding off the first wheel 126 and second wheel 128.

Figure 27:
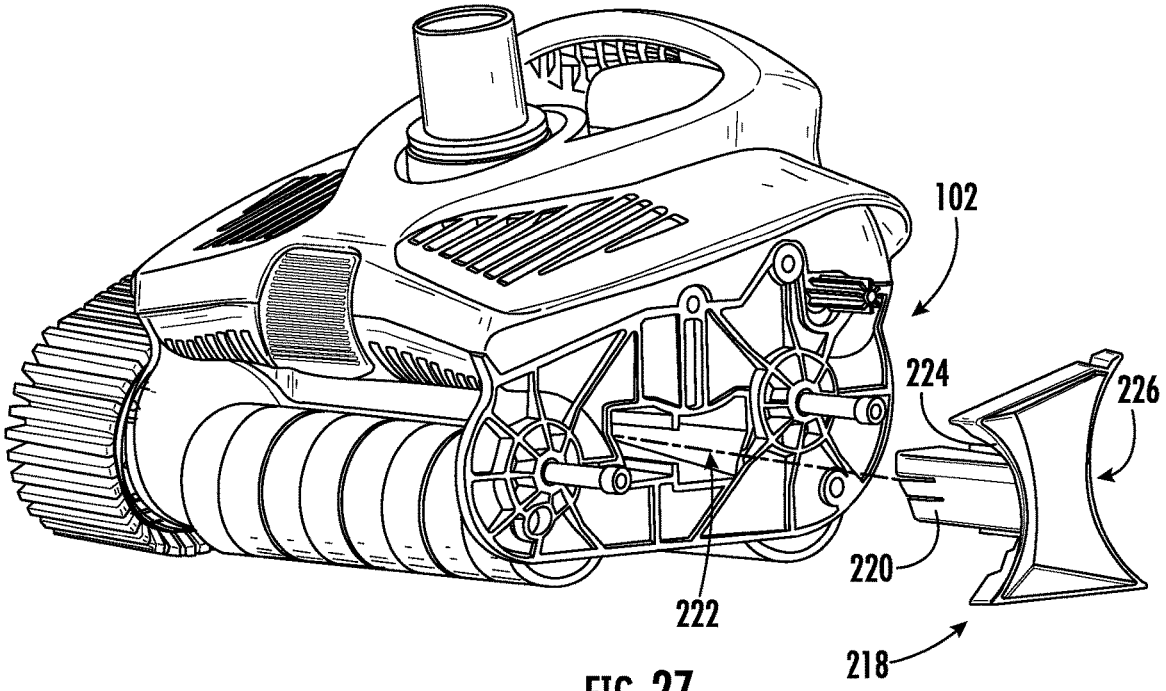
FIG. 27 is a side perspective view of the pool cleaner with the track drive mechanism removed to show how the guard can attach to the housing.

Referring also to FIG. 27, an advantageous safety feature of the pool cleaner 100 will be described. One of the problems with conventional track-driven pool cleaners is that they have large spaces between the tracks and wheels where things such as fingers, hair, and clothing can become stuck. The pool cleaner 100 described here overcomes this problem by including a guard 218 that fits between the first wheel 126 and second wheel 128. As shown in FIG. 26, the guard 218 substantially fills the space between the first wheel 126 and second wheel 128 to prevent object from entering the space.

In FIG. 27, the track mechanism 122 is removed so that the connection mechanism between the guard 218 and housing 102 is visible. The guard 218 includes an insertion member 220 that is inserted into a guard receiving opening 222 defined by the side of the housing 102. A forward section 224 of the guard and a rear section 226 of the guard substantially match the curvature of the second wheel 128 and first wheel 126 respectively so that there is only a small gap between these wheels and the guard 218.

Most parts of the pool cleaner 100 may be constructed of submersible plastic material and may be printed, machined, or molded to the desired shape. Where needed, parts may be connected together with substantially corrosion-proof fasteners such as stainless steel screws, washers, nuts, and the like. The first and second wheels may include conventional wheel bearings to aid rotation.

The pool cleaner 100 is not limited to the details described in connection with the example embodiments. There are numerous variations and modification of the compositions and methods that may be made without departing from the scope of what is claimed.

That which is claimed is:

1. A pool cleaner comprising:

a drive mechanism operable to drive the pool cleaner along a submerged surface of a pool in a forward direction;

a housing carried by the drive mechanism, the housing having a bottom with an inlet port that receives debris removed from the submerged surface;

an outlet port in fluid communication with the inlet port;

a plenum on the bottom for enhancing suction around the inlet port;

a vent mechanism defining at least one opening through the housing forward the outlet port; and a water port defining at least one opening on the bottom, the water port being in fluid communication with the vent mechanism;

wherein when a forward end of the pool cleaner extends above a waterline of the pool, water flows through the vent mechanism and the water port over the plenum so as to prevent loss of suction at the inlet port.

2. The pool cleaner of claim 1, wherein the vent mechanism and water port are positioned in such a way that the waterline passes through the vent mechanism and water port simultaneously.

3. The pool cleaner of claim 1, wherein the water port is positioned forward the inlet port and directly under the vent mechanism.

4. The pool cleaner of claim 1, wherein the plenum includes a recessed area around the inlet port and the water port is positioned forward the recessed area.

5. The pool cleaner of claim 1, wherein the plenum includes a forward retractable member extending laterally across the bottom and forward the inlet port and the water port is positioned directly vertical above the forward retractable member.

6. The pool cleaner of claim 1, wherein:

the vent mechanism is at least partially positioned forward the outlet port; and the plenum includes a forward retractable member extending laterally across the bottom and forward the inlet port and the water port is positioned directly vertical above the forward retractable member and directly under the vent mechanism.

7. The pool cleaner of claim 1, wherein the drive mechanism is operable to drive the pool cleaner along the submerged surface of a pool in the forward direction and a turning direction using a drive train having a pinion gear that operably mates with a wheel gear on a wheel of the drive mechanism; the pool cleaner further comprising:

a cam operable with the pinion gear, the cam including a radially enlarged and a radially constricted section arranged about a circumference of the cam; and a drive shaft contactor connected to the pinion gear and cam in such a way that the pool cleaner changes between moving in the forward direction and turning direction when the drive shaft contactor contacts the radially enlarged or the radially constricted section of the cam, the drive shaft contactor being spring biased against the cam about a rotational axis passing through the drive shaft contactor.

8. The pool cleaner of claim 1, further comprising:

a forward retractable member extending laterally across the bottom and forward the inlet port;

a rear retractable member extending laterally across the bottom and rearward the inlet port; and a protruding member extending downwardly from a plenum top surface and longitudinally between the forward retractable member and rear retractable member;

wherein when the pool cleaner drives over a submerged obstacle, the protruding member contacts the submerged obstacle and tilts the pool cleaner to prevent the pool cleaner from becoming stuck on the submerged obstacle.

9. A pool cleaner comprising:

a drive mechanism operable to drive the pool cleaner along a submerged surface of a pool in a forward direction;

a housing carried by the drive mechanism, the housing having a bottom with an inlet port that receives debris removed from the submerged surface;

an outlet port in fluid communication with the inlet port;

a plenum on the bottom for enhancing suction around the inlet port;

a forward retractable member extending laterally across the bottom and forward the inlet port;

a rear retractable member extending laterally across the bottom and rearward the inlet port; and a protruding member extending downwardly from a plenum top surface and forward between the forward retractable member and rear retractable member;

wherein when the pool cleaner drives over a submerged obstacle, the protruding member contacts the submerged obstacle and tilts the pool cleaner to prevent the pool cleaner from becoming stuck on the submerged obstacle.

10. The pool cleaner of claim 9, wherein when a forward end of the pool cleaner extends above a waterline of the pool, water flows through a vent mechanism and a water port of the housing and over the plenum so as to prevent loss of suction at the inlet port, the vent mechanism and water port being positioned on the housing in such a way that the waterline passes through the vent mechanism and water port simultaneously.

11. The pool cleaner of claim 9, wherein the plenum includes a forward vertical wall forward the inlet port, a rear vertical wall rearward the inlet port and the protruding member contacts the forward vertical wall and rear vertical wall.

12. The pool cleaner of claim 9, wherein the plenum includes a recessed area around the inlet port and the protruding member extends downwardly out of the recessed area.

13. The pool cleaner of claim 9, further comprising:

a vent mechanism defining at least one opening through a top of the housing; and a water port defining at least one opening on the bottom, the water port being in fluid communication with the vent mechanism;

wherein when a forward end of the pool cleaner extends above a waterline of the pool, water flows through the vent mechanism and the water port over the plenum so as to prevent loss of suction at the inlet port.

14. The pool cleaner of claim 9, wherein the drive mechanism is operable to drive the pool cleaner along the submerged surface of a pool in the forward direction and a turning direction using a drive train having a pinion gear that operably mates with a wheel gear on a wheel of the drive mechanism; the pool cleaner further comprising:

a cam operable with the pinion gear, the cam including a radially enlarged and a radially constricted section arranged about a circumference of the cam; and a drive shaft contactor connected to the pinion gear and cam in such a way that the pool cleaner changes between moving in the forward direction and turning direction when the drive shaft contactor contacts the radially enlarged or the radially constricted section of the cam, the drive shaft contactor being spring biased against the cam about a rotational axis passing through the drive shaft contactor.

15. A pool cleaner comprising:

a drive mechanism operable to drive the pool cleaner along a submerged surface of a pool in a forward direction and a turning direction using a drive train having a pinion gear that operably mates with a wheel gear on a first wheel of the drive mechanism;

a housing carried by the drive mechanism, the housing having a bottom with an inlet port that receives debris removed from the submerged surface;

an outlet port in fluid communication with the inlet port;

a cam operable with the pinion gear, the cam including a radially enlarged and a radially constricted section arranged about a circumference of the cam; and a drive shaft contactor connected to the pinion gear and cam in such a way that the pool cleaner changes between moving in the forward direction and turning direction when the drive shaft contactor contacts the radially enlarged or the radially constricted section of the cam, the drive shaft contactor being spring biased against the cam about a rotational axis passing through the drive shaft contactor.

16. The pool cleaner of claim 15, wherein when a forward end of the pool cleaner extends above a waterline of the pool, water flows through a vent mechanism and a water port of the housing and over a plenum on the bottom for enhancing suction around the inlet port so as to prevent loss of suction at the inlet port, the vent mechanism and water port being positioned on the housing in such a way that the waterline passes through the vent mechanism and water port simultaneously.

17. The pool cleaner of claim 15, further comprising:

a plenum formed on the bottom for enhancing suction around the inlet port;

a vent mechanism defining at least one opening through a top of the housing; and a water port defining at least one opening on the bottom, the water port being in fluid communication with the vent mechanism;

wherein when a forward end of the pool cleaner extends above a waterline of the pool, water flows through the vent mechanism and the water port over the plenum so as to prevent loss of suction at the inlet port.

18. The pool cleaner of claim 15, further comprising:

a plenum formed on the bottom for enhancing suction around the inlet port;

a forward retractable member extending laterally across the bottom and forward the inlet port;

a rear retractable member extending laterally across the bottom and rearward the inlet port; and a protruding member extending downwardly from a plenum top surface and longitudinally between the forward retractable member and rear retractable member;

wherein when the pool cleaner drives over a submerged obstacle, the protruding member contacts the submerged obstacle and tilts the pool cleaner to prevent the pool cleaner from becoming stuck on the submerged obstacle.

19. The pool cleaner of claim 15, wherein the drive mechanism includes a track wrapped around the first wheel and a second wheel, the first wheel having a larger diameter than the second wheel.

20. The pool cleaner of claim 15, wherein the drive mechanism includes a track wrapped around the first wheel and a second wheel; the track, first wheel, and second wheel defining a space therebetween; and a guard substantially filling the space to prevent objects from entering the space.

* * * * *